US009613508B2

(12) United States Patent
Park et al.

(10) Patent No.: US 9,613,508 B2
(45) Date of Patent: Apr. 4, 2017

(54) SECURITY MONITORING APPARATUS AND METHOD USING CORRELATION COEFFICIENT VARIATION PATTERN OF SOUND FIELD SPECTRUM

(71) Applicant: Electronics and Telecommunications Research Institute, Daejeon (KR)

(72) Inventors: Kang-Ho Park, Daejeon (KR); Sung Q Lee, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 250 days.

(21) Appl. No.: 14/671,209

(22) Filed: Mar. 27, 2015

(65) Prior Publication Data

US 2015/0279181 A1 Oct. 1, 2015

(30) Foreign Application Priority Data

Mar. 31, 2014 (KR) ..... 10-2014-0037914
Oct. 27, 2014 (KR) ..... 10-2014-0146266

(51) Int. Cl.
*G08B 13/16* (2006.01)
*G08B 17/00* (2006.01)
*G08B 19/00* (2006.01)

(52) U.S. Cl.
CPC ..... *G08B 13/1672* (2013.01); *G08B 17/00* (2013.01); *G08B 19/005* (2013.01)

(58) Field of Classification Search
CPC .. G08B 13/1672; G08B 17/00; G08B 19/005; G08B 13/1618; G08B 13/19695;
(Continued)

(56) References Cited

U.S. PATENT DOCUMENTS 3,681,745 A * 8/1972 Perlman ..... G01S 15/523 342/28
3,896,411 A * 7/1975 Mackey ..... G01S 7/527 367/901

(Continued)

FOREIGN PATENT DOCUMENTS

GB 1358931 A 7/1974
KR 10-2011-0067243 A 6/2011

(Continued)

*Primary Examiner* — Daniel Pihulic

(57) ABSTRACT

Provided is a security monitoring method including outputting a multi-tone sound wave configured with a linear sum of sine waves having a plurality of frequency components inside a security monitoring space, receiving the multi-tone sound wave and calculating a sound field, calculating and storing sound field information according to frequency through the sound field, comparing reference sound field information according to frequency with the currently measured sound field information and determining whether a sound field variation occurs, and analyzing whether the sound field variation occurs collected for a certain predetermined period and distinguishing at least two events among intrusion, motion and temperature variation situations on the basis of correlation between the reference sound field spectrum and consecutive sound field spectra.

20 Claims, 32 Drawing Sheets

(58) Field of Classification Search
CPC ..... G08B 13/19697; G08B 13/1609; H04R 29/007
See application file for complete search history.

(56) References Cited

U.S. PATENT DOCUMENTS

| | | | | |
|---|---|---|---|---|
| 3,961,321 | A * | 6/1976 | Moss | G08B 13/1627 342/27 |
| 5,760,687 | A | 6/1998 | Cousy | |
| 7,643,377 | B1 * | 1/2010 | Uzes | G01S 3/04 367/135 |
| 7,791,475 | B2 * | 9/2010 | Clow | G08B 17/10 340/506 |
| 8,797,407 | B2 * | 8/2014 | Lee | G01S 15/526 348/152 |
| 9,197,976 | B2 * | 11/2015 | Park | G08B 13/19695 |
| 2004/0207409 | A1 | 10/2004 | Ariav et al. | |
| 2011/0141283 | A1 | 6/2011 | Lee et al. | |
| 2012/0140597 | A1 | 6/2012 | Park et al. | |
| 2013/0162821 | A1 * | 6/2013 | Park | G08B 13/19695 348/143 |
| 2014/0307096 | A1 * | 10/2014 | Park | G08B 13/1672 348/152 |
| 2015/0279181 | A1 * | 10/2015 | Park | G08B 13/1672 367/136 |
| 2017/0016797 | A1 * | 1/2017 | Park | G01M 3/24 |

FOREIGN PATENT DOCUMENTS

| | | | | |
|---|---|---|---|---|
| KR | 10-2012-0063272 | A | 6/2012 | |
| KR | 10-2013-0074437 | A | 7/2013 | |
| KR | 10-2014-0124317 | A | 10/2014 | |
| KR | GB 2526666 | A * | 12/2015 | G08B 13/1672 |
| WO | WO 03/036321 | A2 | 5/2003 | |

* cited by examiner

SECURITY MONITORING APPARATUS AND METHOD USING CORRELATION COEFFICIENT VARIATION PATTERN OF SOUND FIELD SPECTRUM

CROSS-REFERENCE TO RELATED APPLICATIONS

This U.S. non-provisional patent application claims priority under 35 U.S.C. §119 of Korean Patent Application Nos. 10-2014-0037914, filed on Mar. 31, 2014, and 10-2014-0146266, filed on Oct. 27, 2014, the entire contents of which are hereby incorporated by reference.

BACKGROUND OF THE INVENTION

The present invention disclosed herein relates to a security monitoring apparatus and method capable of detecting whether a dangerous situation occurs on the basis of a variation pattern of correlation coefficients between sound field spectra according to multi-tone frequencies on the basis of a sound field variation according to a time, and distinguishably detecting intrusion, motion, fire, and ordinary temperature variation situations for each other.

Security sensors used for independently detecting intrusion and a fire situation have been researched and used for a long time. A sensor for detecting intrusion may use one of a passive infrared (PIR) type, an active infrared (IR) type, an ultrasound type, a sound sensing type, a vibration sensing type, and a microwave sensing type, and a sensor for sensing fire may use one of a temperature sensing type, a smoke sensing type, a gas sensing type, and a flame sensing type.

However, as described above, those sensors are used for sensing one of intrusion and fire situations. A security sensor that distinguishes an intrusion situation from a fire situation with one sensor is recently proposed in a type using a principle that a sound field variation pattern measured by using a sound source having multi-tone frequencies is detected, features are extracted according to time and frequency variations, and the extracted features are analyzed.

As an existing technique, Korean patent application laid open No. 2011-0142499 discloses a security system and method through a pattern analysis of sound field variation, which provides a sound field security pattern technique for calculating an average and a deviation of a sound field, detecting a dangerous situation of intrusion on the basis of a variation value (SNR) of an average value of the sound field to an initial deviation of a reference sound field, and issuing an alarm. However, this patent invention has weaknesses in that a time is taken to determine a reference value since measurements are required to be performed twice or more at an initial stage for obtaining the reference sound field deviation, and that reliability of intrusion detection is vulnerable to randomness of a reference deviation obtained by measurements of the limited number of times and inaccuracy of the method of detecting the sound field variation. In addition, such a method has difficulty in distinguishing intrusion, fire, and motion situations for each other.

As another existing technique, Korean patent application laid open no. 2013-0122862 discloses a security monitoring system and method, which provides a technique for distinguishing a fire situation from an intrusion situation by distinguishing feature of the fire situation where a sound field pattern is not varied in shape but moves in a high frequency direction in a temperature increase variation such as fire from the feature of the intrusion situation where the shape itself of a sound field pattern varies. However, the patent invention has difficulty in accurate quantitative determination, since reliability is vulnerable to inaccuracy of the method of detecting a sound field variation with a variation value (SNR) of an average value of the sound field to a deviation of a reference sound field, there are lots of arbitrariness in a method of quantizing a variation degree of a pattern shape and a method of deriving a similarity index through a difference index, and a frequency movement index is variable according to a situation. In addition, there is also difficulty in detection by distinguishing a motion, etc.

SUMMARY OF THE INVENTION

The present invention provides a security monitoring apparatus and method that has high reliability by detecting whether a dangerous situation occurs which causes a sound field variation on the basis of a variation pattern of a correlation coefficient between sound field spectra according to multi-tone frequencies on the basis of a sound field variation according to a time, and distinguishably detecting intrusion, motion, fire, and ordinary temperature variation situation such as daily temperature range, and air conditioning and heating.

The present invention also provides a security monitoring apparatus and method based on pattern variation detection of a correlation coefficient of a sound field spectrum, which provide comprehensive security monitoring by distinguishing and detecting intrusion, motion, and fire situations and confirming the detection by capturing an image.

Embodiments of the present invention provide security monitoring methods of a security monitoring device, wherein the method includes: outputting a multi-tone sound wave configured with a linear sum of sine waves having a plurality of frequency components inside a security monitoring space; receiving the multi-tone sound wave and calculating a sound field; calculating and storing sound field information according to frequency through the sound field; comparing reference sound field information according to frequency with the currently measured sound field information and determining whether a sound field variation occurs; and analyzing whether the sound field variation occurs collected for a certain predetermined period and distinguishing at least two events among intrusion, motion and temperature variation situations on the basis of correlation between the reference sound field spectrum and consecutive sound field spectra in the predetermined period.

In some embodiments, the correlation may be obtained by calculating a correlation coefficient value between the reference sound field spectrum and the consecutive sound field spectra.

In other embodiments, the correlation may be obtained by using a correlation coefficient calculated by dividing a covariance value of the reference sound field spectrum and the consecutive sound field spectra by multiplication of standard deviations of the reference sound field spectrum and the consecutive sound field spectra.

In still other embodiments, the method may further include: comparing the reference sound field spectrum and a current sound field spectrum to determine whether a dangerous situation causing the sound field variation occurs; analyzing sound field spectra collected for a certain interval before the dangerous situation occurs and distinguishing an intrusion, temperature variation, or motion situation; and distinguishing situations of the intrusion, motion, fire, and ordinary temperature variation including daily temperature range, and air conditioning and heating on the basis of the correlation coefficient between the reference sound field spectrum and the consecutive sound field spectra.

In even other embodiments, whether the dangerous situation occurs may be determined by comparing the correlation coefficient between the reference sound field spectrum and the current sound field spectrum with a set reference value.

In yet other embodiments, whether the dangerous situation occurs may be determined by using the correlation coefficient between the reference sound field spectrum and the current sound field spectrum, and comparing a value obtained by subtracting from 1 an initial correlation coefficient at the time of initial sound field measurement as an index representing a degree of difference between the sound field spectrums with a value obtained by subtracting from 1 a correlation coefficient between a current sound field and a reference sound field.

In further embodiments, a variation pattern of the correlation coefficient between the reference sound field spectrum and the consecutive sound field spectrum may be used, a rapid reduction right before the occurrence of the dangerous situation may be determined as the intrusion, and a gradual reduction before the occurrence of the dangerous situation may be determined as the temperature variation situation.

In still further embodiments, the intrusion and temperature variation situations may be distinguished by comparing a ratio of a value obtained by subtracting from 1 an average value of the correlation coefficient between the reference sound field spectrum and the consecutive sound field spectra before occurrence of a dangerous situation and a value obtained by subtracting from 1 a correlation coefficient between a sound field spectrum at a time point of occurrence of the dangerous situation and the reference sound field spectrum.

In even further embodiments, a temporal variation aspect of a correlation coefficient between the reference sound field spectrum and the consecutive sound field spectra may be analyzed, the irregularly increased and decreased variation aspect may be determined as a motion, and the variation aspect of rapidly reduced is determined as an intrusion situation.

In yet further embodiments, the method may further include: comparing the reference sound field spectrum and a current sound field spectrum and determining whether a sound field variation occurs; and analyzing sound field spectra according to frequency, which are collected for a predetermined period before occurrence of the sound field variation situation and distinguishing a motion of a human/animal, fire, and an ordinary temperature variation situation including daily temperature range, and air conditioning and heating.

In much further embodiments, the method may further includes comparing the correlation coefficient between the reference sound field spectrum and current sound field spectrum with a set reference value to determine whether the sound field variation situation occurs.

In still much further embodiments, a temporal variation aspect of the correlation coefficient between the reference sound field spectrum and the consecutive sound field spectra may be analyzed, when the variation aspect is irregular, the situation may be determined as motion, and when the variation aspect is uniformly gradually reduced, the situation may be determined as temperature variation situation.

In even much further embodiments, a correlation coefficient between the reference sound field spectrum and the consecutive sound field spectra in a predetermined period before occurrence of the sound field variation situation may be used, a ratio of a value obtained by summing absolute values of differences between adjacent correlation coefficients obtained by consecutive measurement in a predetermined period and a value obtained by subtracting from 1 a correlation coefficient at a time point of detection of the sound field variation may be set as a movement index, and the motion and the temperature variation may be distinguished by using the movement index.

In yet much further embodiments, an index representing a frequency movement degree of the sound field spectrum may be derived on the basis of a cross correlation coefficient between the reference sound field spectrum and the consecutive sound field spectra, which may be obtained by adopting multi-tone frequency index as a variable, and a fire situation or an ordinary temperature variation situation including daily temperature range and air-conditioning and heating may be distinguished by considering a direction and duration of the frequency movement.

In still even much further embodiments, the method may further included detecting and storing motion information on a human and an animal inside a security space by using sound field information; and transmitting the detection information to a smart phone and a smart device of a protector.

In still yet much further embodiments, the method may further include delivering an alarm of occurrence of accident including falling, fainting, and invalidity, and transmitting security information at the time when the motions of a human and an animal in the security space are not detected for a pre-determined time.

In yet even still much further embodiments, the method may further include selectively detecting only a fire situation in a state where there is a motion of a human or an animal in the security space, delivering a fire alarm, and transmitting security information.

In even yet still much further embodiments, the method may further include storing image information in a case of occurrence of a security situation, and capturing an image for verifying the situation.

In another still yet much further embodiments, the security monitoring method may be linked to a security camera having a network function, and smart appliances including an internet phone, a smart TV, and an interphone such as a door-phone or a video-phone.

In even still much further embodiments, at the time of interaction, the link may be implemented with software without addition of hardware of interaction device.

In yet even still much further embodiments, the security monitoring method may be executed with remote control or transmits acquired security information at the time of execution of an App type program related to a smart phone or a smart device of a user.

In other embodiments of the present invention, security monitoring apparatuses including: a sound generating device outputting a sound wave according to an input voltage in a security monitoring space; a sound wave receiving device receiving the sound wave and calculating a sound field by using the sound wave; and a sound field signal processing device calculating sound field spectrum information on the sound field through consecutive measurement, calculating a cross correlation coefficient between the consecutive sound field spectrum information and reference sound field spectrum information, and distinguishing at least two events among intrusion, motion, and temperature variation situations through the cross correlation coefficient.

In some embodiments, the sound wave may be a multi-tone sound wave configured with a linear sum of sine waves having a plurality of frequency components.

In still other embodiments, the sound field signal processing device may calculate a sound transfer function by using of sound pressure or a phase of the sound field.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

Hereinafter, exemplary embodiments will be described in more detail with reference to the accompanying drawings that are used to help those skilled in the art to easily practice the technical idea of the present invention.

Figure 1:
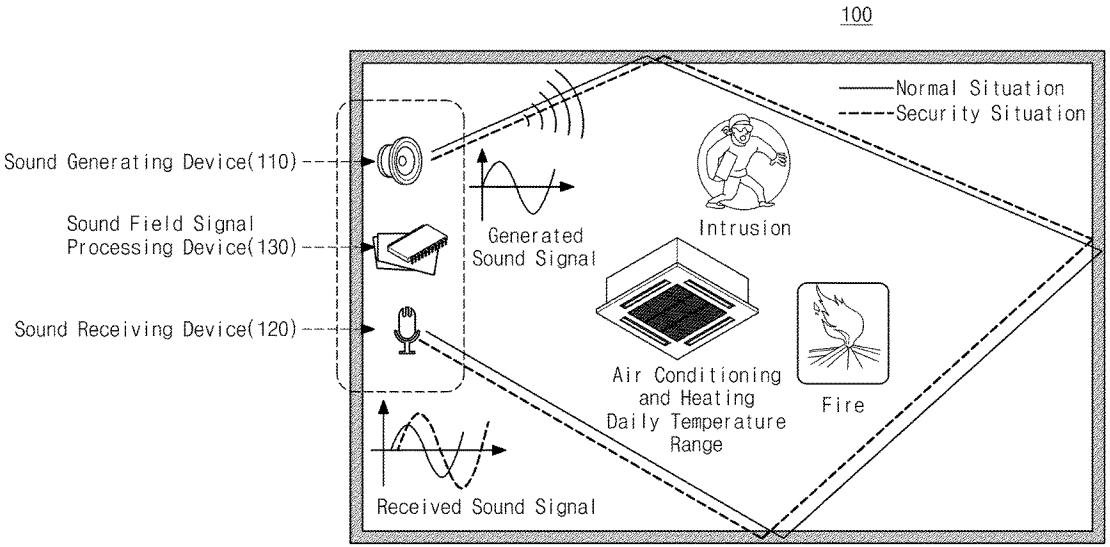
FIG. 1 is a block diagram of a security monitoring apparatus for distinguishing and detecting intrusion, fire, and ordinary temperature variation such as air conditioning and heating, and daily temperature range, on the basis of a correlation coefficient of a sound field spectrum.

FIG. 1 is a block diagram of a security monitoring apparatus for distinguishing to detect intrusion, fire, and ordinary temperature variation such as air conditioning and heating, and daily temperature range, on the basis of correlation coefficients of a sound field spectrum. Referring to FIG. 1, a security monitoring apparatus 100 includes a sound generating device 110, a sound receiving device 120, and a sound field signal processing device 130.

The sound generating device 110 may output a sound wave according to an input voltage in a security monitoring space. Here, the sound wave output from the sound generating device 110 may be a multi-tone sound wave including a linear sum of sine waves having a plurality of frequency components in an audio frequency of about 20 Hz to about 20 k Hz or in a ultrasound region over 20 kHz. Here, the multi-tone sound wave may be in a type of a continuous wave or a pulse wave.

The sound pressure of the sound generating device 110 may be driven at a rated power thereof and set as optimal amplitude through which a sound field variation is detectable according to security situation occurrence.

The sound receiving device 120 may receive the sound wave in the security monitoring space and obtain the sound pressure from the received sound wave. Here, the sound receiving device 120 may include a frequency converting filter converting the received sound wave into a signal in a frequency domain.

The sound field signal processing device 130 is a device determining an intrusion or fire situation by using a sound field variation in the security monitoring space, and may be implemented through processors such as a smart device and a digital signal processor (DSP). A sound field value may be represented as sound pressure and a phase, and the sound pressure and phase may be available individually or combinedly. However, in the present embodiment, the sound pressure is presented as one example, and a sound pressure level that is the amplitude of the sound pressure is used for a signal processing target. Here, the sound pressure level may be typically represented as a log function and may be a value obtained by measuring, by the sound receiving device 120, sound pressure in the security monitoring space. Here, the sound pressure in the security monitoring space is sound pressure appeared when sound pressure output from the sound generating device 110 is dispersed in the security monitoring space.

Accordingly, the sound field signal processing device 130 may calculate reference sound pressure information (the amplitude (Amp=20 log P) of reference sound pressure) or a phase (Ph=ang (P)) of the reference sound pressure by using sound pressure (P) of a sound in a preparation mode. In this case, the sound field signal processing device 130 may measure a variation pattern according to time of a sound field spectrum for solving malfunction issues caused by a variation of the sound pressure (P) due to an environmental change such as gradual temperature and humidity changes of the air. The sound field signal processing device 130 may analyze the measured sound field spectrum variation pattern according to time to set an initialization time period of the reference sound field and a reference value of security situation determination.

In addition, the sound field signal processing device 130 may calculate current sound pressure information (amplitude (Amp=20 log (P') of the current sound pressure) or a phase (Ph=ang (P')) of the current sound pressure by using a sound transfer function (P') in a monitoring mode, and then compare the reference sound pressure information with the current sound pressure information to determine whether a security situation of fire or intrusion occurs.

In detail, the sound field signal processing device 130 may determine whether a dangerous situation of intrusion or fire occurs through several methods. According to an existing method, when a reference deviation (noise) is compared with a signal value (signal) (hereinafter, 'a sound pressure change to a reference deviation ratio: SNR') and if the comparison result SNR' is larger than a predetermined reference value SNR, the security situation is determined to occur. Here, a reference deviation may be a maximum value of a deviation of the reference sound pressure information for each frequency, and the signal value may be a value obtained by taking an absolute value (20 log (P')−20 log (P)) for a difference between an average of the reference sound pressure information for each frequency and an average of the current sound pressure information for each frequency.

In this case, the sound field signal processing device 130 may re-set the reference sound field value according to the initialization time period in order to prevent an alarm from being wrongly rang, which is caused by a sound pressure (P) change due to gradual temperature and humidity variations in the air. Such re-setting may be performed by calculating an average and a deviation of the sound pressure for each frequency in the initialization time period interval in a monitoring mode. A sound field measured in a case of non-dangerous normal situation may be set as the reference sound field.

Similarly, when fire occurs in the security monitoring space, a sound wave speed varies due to a temperature variation of the air. Accordingly, a sound field variation occurs and the sound receiving device installed in the security monitoring space may differently detect a sound field of a sound wave according to a temperature distribution state.

Referring to FIG. 1 again, since a boundary condition is changed at the time of occurrence of an intrusion situation in the security monitoring space, a sound field varies accordingly. Such a sound field variation phenomenon may occur more strongly in a sound space where an echo of the sound wave frequently occurs. When the sound field variation is detected like this, intrusion into a blind spot or fire at a blind spot where a flame or smoke is not observed may also be detected. Furthermore, misrecognition of a dangerous situation may occur due to a sound field variation appearing due to air-conditioning and heating or daily temperature range. Procedures and processes for distinguishing this situation are necessary.

The existing security monitoring method quantifies a variation degree on the basis of a variation value of a sound field average to a deviation of the reference sound field, namely signal to noise ratio (SNR), obtained by measuring the sound field variation the plurality number of times at an initial stage. This method takes a time for measuring a deviation (i.e., noise) of an initial sound field, and inaccuracy is derived by reference deviations of the limited number of times. In addition, in a case where the initial sound field deviation is 0, a problem of occurrence of an error in calculation is required to be considered. Moreover, for a method of obtaining a sound field variation with a variation value of an average value to a reference deviation for each frequency, there is a limit that an error becomes large since the reference deviation is relatively large when sound pressure at a frequency of destructive interference appears very low.

On the contrary, a security monitoring method according to an embodiment of the present invention may improve reliability in detection and distinguishment of a dangerous situation, since a correlation coefficient is calculated for precisely deriving similarity between a reference sound field spectrum and a varied current sound field spectrum, and a degree of the sound field variation is quantified based on this correlation coefficient.

Figure 2:
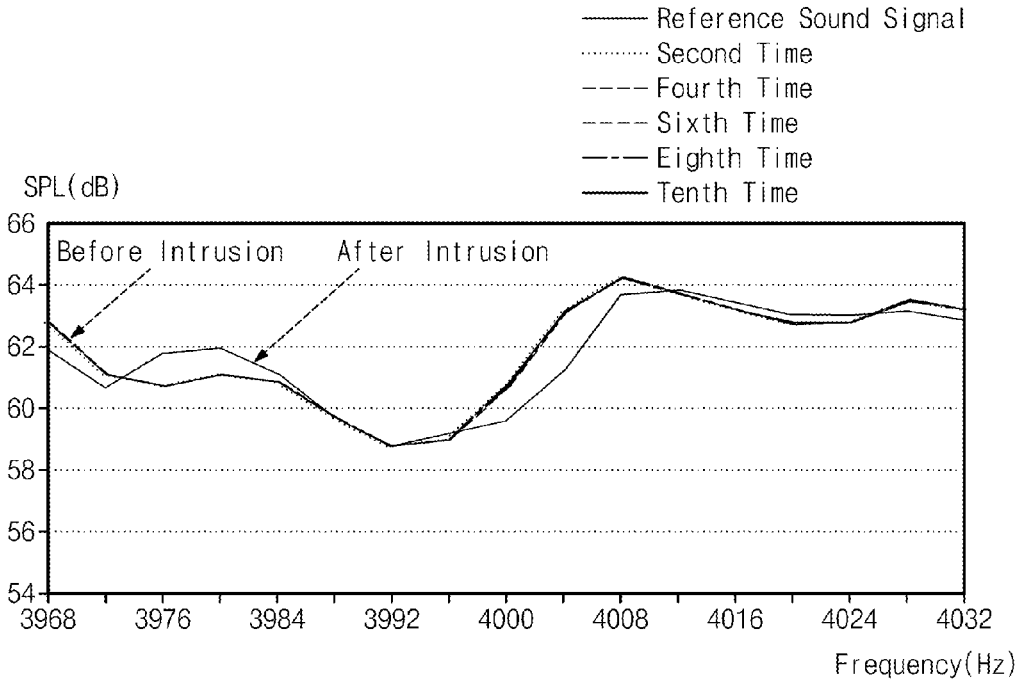
FIG. 2 is a view representing a sound field spectrum variation appeared when an abrupt intrusion situation occurs in measurements of a reference sound field and consecutive sound fields by using a multi-tone sound source having a central frequency of 4 kHz and a frequency interval of 4 Hz.

FIG. 2 is a view representing a sound field spectrum variation appeared when an abrupt intrusion situation occurs in measurements of reference sound field and consecutive sound fields by using a multi-tone sound source having a central frequency of 4 kHz and a frequency interval of 4 Hz. FIG. 2 shows an experiment result that the reference sound field spectrum is measured in the security monitoring space and then a sound field spectrum is consecutively measured 10 times with a time interval of 8 seconds. First to ninth spectrums are sound field spectra before intrusion, and a tenth spectrum is a sound field spectrum obtained after the intrusion situation occurs.

A multi-tone sound source used for sound field measurement has a central frequency of 4 kHz and a frequency interval 4 Hz, and frequencies of total 17 channels. The sound generating device 110 generates a sound source for 0.5 sec. The sound receiving device 120 receives the generated sound signal. The sound field signal processing device 130 obtains a sound field spectrum by frequency-filtering the sound signal. Referring to FIG. 2 again, the sound field spectrum before the intrusion has little variation. However, after the intrusion, a condition is changed by an intruder and accordingly the sound field spectrum is largely changed.

Figure 3A:
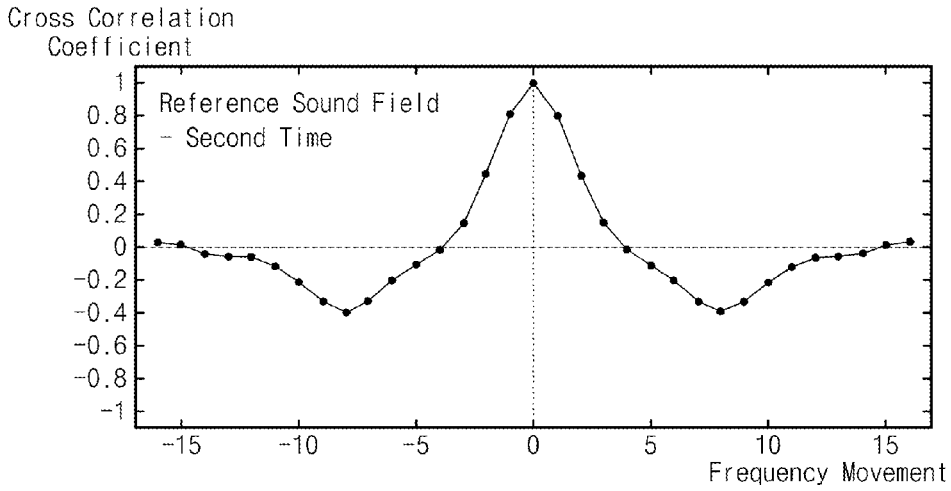
FIGS. 3*a* to 3*c* are views respectively representing cross correlation coefficient variations in second (before intrusion), sixth (before intrusion), and tenth (after intrusion) measurements, obtained by adopting, as a variable, a frequency movement (4 Hz unit) between a reference sound field measurement value and each of consecutive measurement values in sound field spectra obtained from FIG. 2.
Figure 3B:
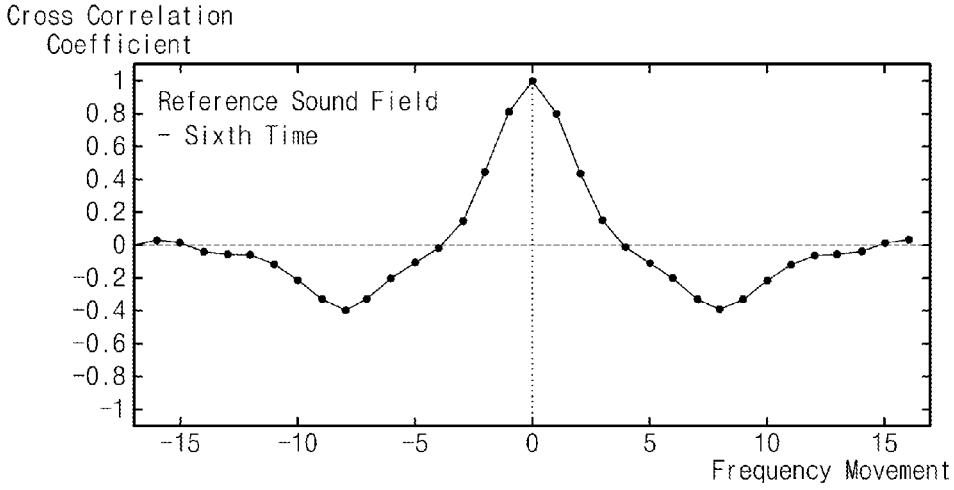
Figure 3C:
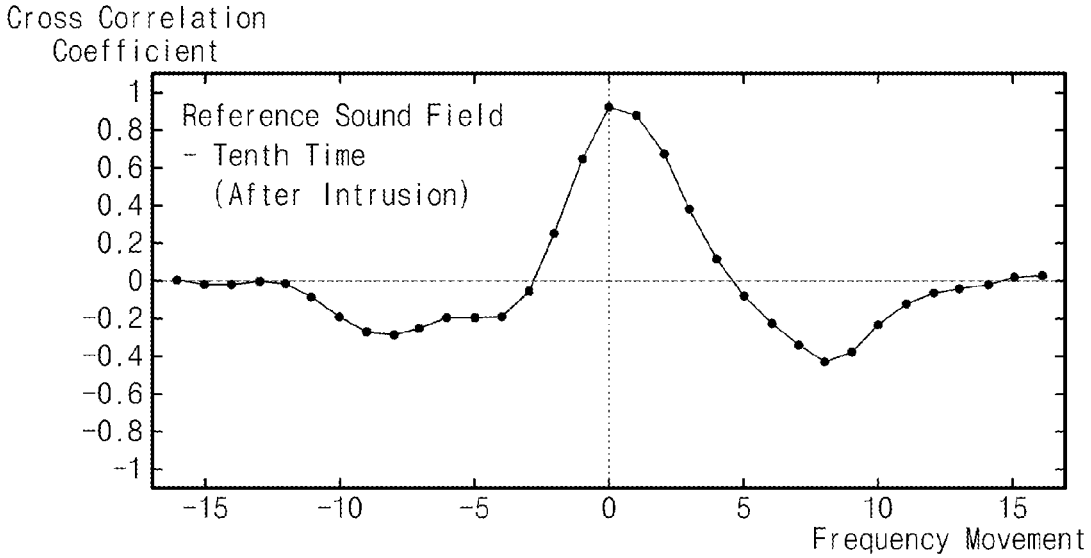

FIGS. 3*a* to 3*c* are views respectively representing cross correlation coefficients obtained by adopting, as a variable, a frequency movement index between the reference sound field spectrum and each of secondly, sixthly, and tenthly measured sound field spectra. The cross correlation coefficients may be represented as the following Equation (1).

$$R_{i,j}(m) = \frac{\sum_{n=1}^{N-m} (S_j(n+m) - \text{mean}(S_j))(S_i(n) - \text{mean}(S_i))}{\sqrt{\sum_{n=1}^{N} (S_i(n) - \text{mean}(S_i))^2}\sqrt{\sum_{n=1}^{N} (S_j(n) - \text{mean}(S_j))^2}}, \quad m \geq 0 \tag{1}$$

$$R_{i,j}(m) = R_{j,i}(-m),\ m < 0$$

where $R_{i,j}$ denotes a cross correlation coefficient between an ith measured sound field $S_i$, and jth measured sound field $S_j$, N denotes the number of channels of a multi-tone sound source. m denotes a frequency interval index neighboring the multi-tone sound source as a unit of frequency movement value.

In detail, when m=0, the cross correlation coefficient is a result of dividing a covariance value of two sound field spectra without frequency movement by a multiplication of standard deviation values of ith and jth measured sound field spectra. In addition, when m is not 0, the cross correlation coefficient is a result that the cross correlation coefficient is calculated between ith sound field spectrum and jth sound field spectrum that moves in frequency by m times of frequency interval.

Referring to FIGS. 3*a* to 3*c*, the cross correlation coefficients $R_{0,2}(m)$ and $R_{0,6}(m)$ are almost similar between the reference sound field spectrum and sound field spectra before the intrusion (the second and sixth). However, cross correlation coefficient $R_{0,10}(m)$ may be largely differed between the reference sound field spectrum and the sound field spectrum after the intrusion (the tenth).

Figure 4:
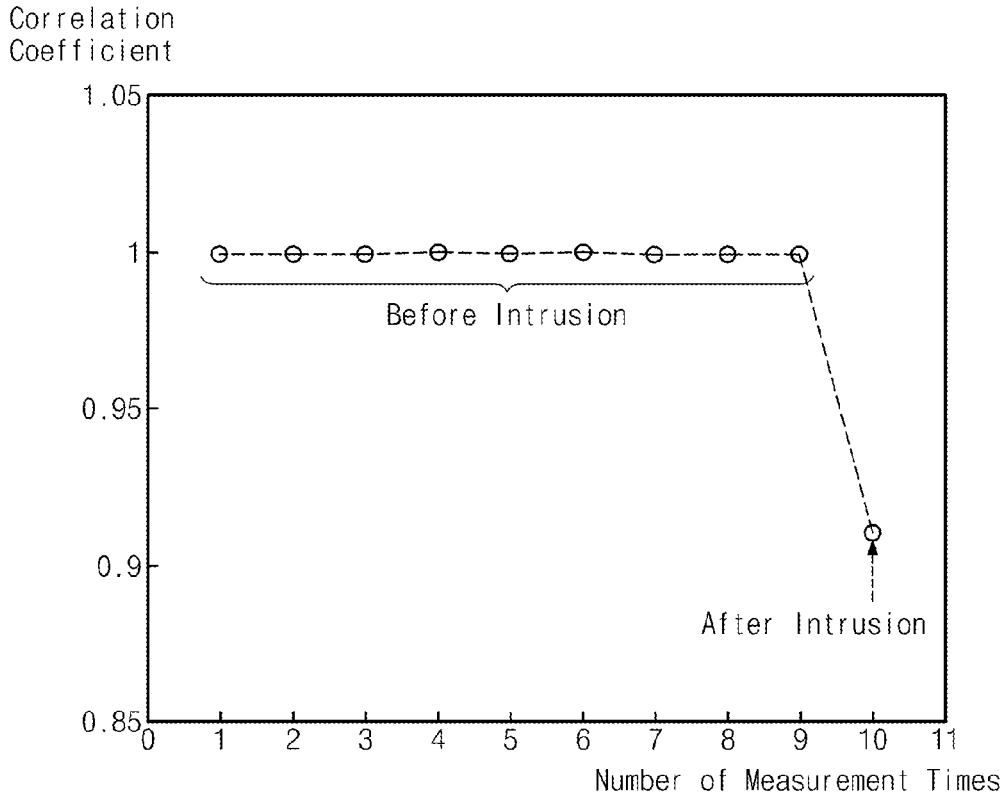
FIG. 4 is a view representing a correlation coefficient without frequency movement (m=0) between a reference sound field measurement value and each of consecutive measurement values in the sound field spectra obtained from FIG. 2.

FIG. 4 is a view representing correlation coefficients without frequency movement (m=0) between the reference sound field measurement value and consecutive measurement values in the sound field spectra obtained from FIG. 2. Referring to FIG. 4, the cross correlation coefficient is almost close to 1 before the intrusion when m=0 in Equation (1). On the contrary, after the intrusion, the correlation coefficient is rapidly reduced to about 0.91.

Figure 5:
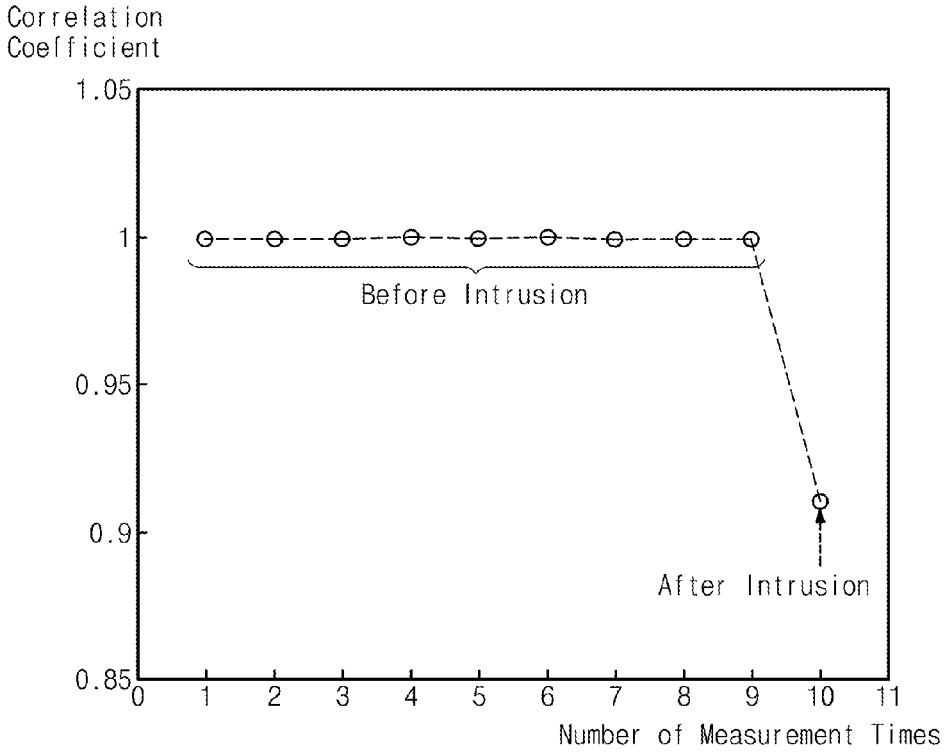
FIG. 5 is a view representing for each measurement time, a maximum value of a cross correlation coefficient obtained in consideration of a frequency movement between a reference sound field measurement value and each of consecutive measurement values in the sound field spectra obtained from FIG. 2.

FIG. 5 is a view representing, for each measurement time, a maximum value of a cross correlation coefficient obtained in consideration of a frequency movement between a reference sound field measurement value and consecutive measurement values in the sound field spectra obtained from FIG. 2. FIG. 5 shows a maximum coefficient of cross correlation with the reference sound field spectrum for each measurement in consideration of all cases of frequency movements, namely, when m is not 0 in Equation (1). For example, since all become the maximum value only when m=0, the result is the same as that of FIG. 4.

Figure 6:
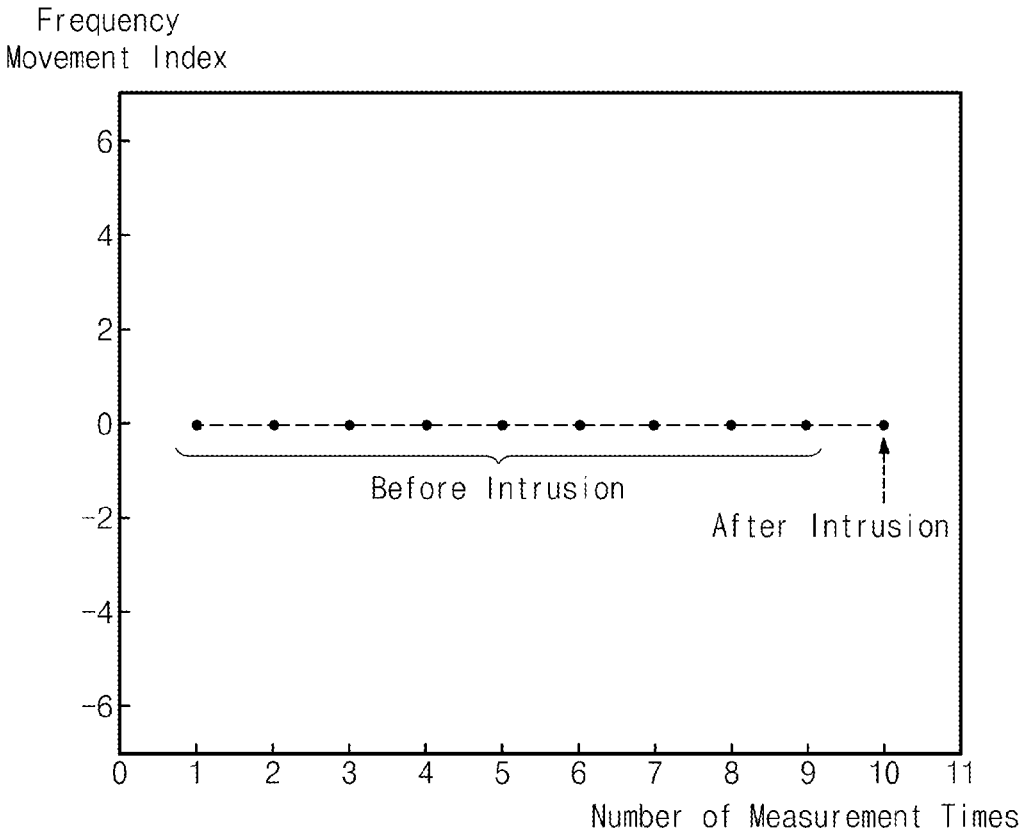
FIG. 6 is a view representing for each measurement time, a frequency movement index corresponding to a maximum value of a correlation coefficient in order to represent how far a spectrum moves in frequency in consecutive measurement in comparison to a reference sound field in the sound field spectra of FIG. 2.

FIG. 6 is a view representing for each number of measurement times, a frequency movement index corresponding to a maximum value of a correlation coefficient in order to represent how far a spectrum moves in frequency in consecutive movement in comparison to the reference sound field in the sound field spectra of FIG. 2. Referring to FIG. 6, as shown in FIG. 5, when m is 0, since all cross correlation coefficients are the maximum value, the frequency movement indexes are all 0.

Figure 7:
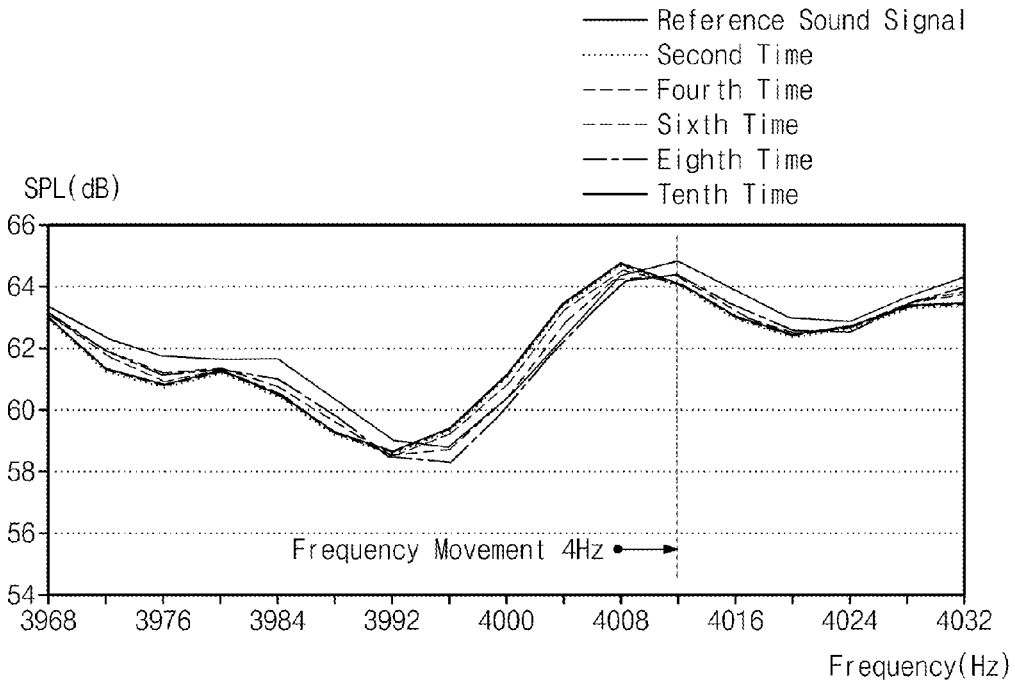
FIG. 7 is a view representing a gradual variation of a sound field spectrum appeared when a temperature variation caused by a fire situation occurs from the beginning time in measurements of the reference sound field and consecutive sound fields by using a multi-tone sound source having a central frequency of 4 kHz and a frequency interval of 4 Hz.

FIG. 7 is a view representing a gradual variation of a sound field spectrum appeared when a temperature variation caused by a fire situation occurs from the beginning time in measurements of reference sound field and consecutive sound fields by using a multi-tone sound source having a central frequency of 4 kHz and a frequency interval of 4 Hz. FIG. 7 shows an experiment result that after the reference sound field spectrum is measured in the security monitoring space, an artificial fire situation is constructed by using an electric heater and a sound field spectrum is consecutively measured 10 times with a time interval of 8 seconds. As shown in FIG. 7, the sound field spectrum moves gradually in a high frequency direction.

Typically, a sound wave speed v may be expressed as the following equation (2) and is proportional to a temperature T in Celsius of the air.

$$v=331.5+0.6T \tag{2}$$

Accordingly, although a frequency f of the sound wave is identical, a wavelength λ increases proportionally to a temperature T of the air according to Equations (3) and (4).

$$v=f\cdot\lambda \tag{3}$$

$$\lambda=(331.5+0.6T)/f \tag{4}$$

When a temperature of the air in the security space increases, the sound wave speed increases. Accordingly, a wavelength in an identical frequency proportionally increases. Since the internal size of the security space is fixed, when the temperature increases, the sound wave wavelength is required to be constant in order for sound receiving devices located at an identical position to have the same sound pressure. Finally a sound pressure level pattern moves in a high frequency direction without change of the shape thereof. At this point, a variation value δf of the moving frequency may be simply expressed as the following Equation (5).

$$\delta f=f*\delta v/v \tag{5}$$

Since a speed change δv of the sound wave is proportional to a temperature variation δT in Equation (2), the frequency change value δf is proportional to the frequency of the sound wave and also proportional to a temperature variation.

$$\delta f=0.6*f*\delta T/v \tag{6}$$

A temperature variation of the air due to actual fire is difficult to simplify with an entire temperature increase. Local temperature variation around the fire and the entire temperature variation occur complicatedly. However, a degree that a sound pressure level pattern moves towards a high frequency due to a temperature increase may be typically monitored by monitoring an internal temperature variation of the air. For example, when the central frequency of the multi-tone frequency is about 4 kHz and a frequency interval is about 4 Hz, a temperature variation amount δ T corresponds to about 0.57° C. at room temperature (T=18° C.) according to the following Equation (7).

$$\delta T=\frac{\delta f(331.5+0.6T)}{0.6f} \tag{7}$$

Figure 8A:
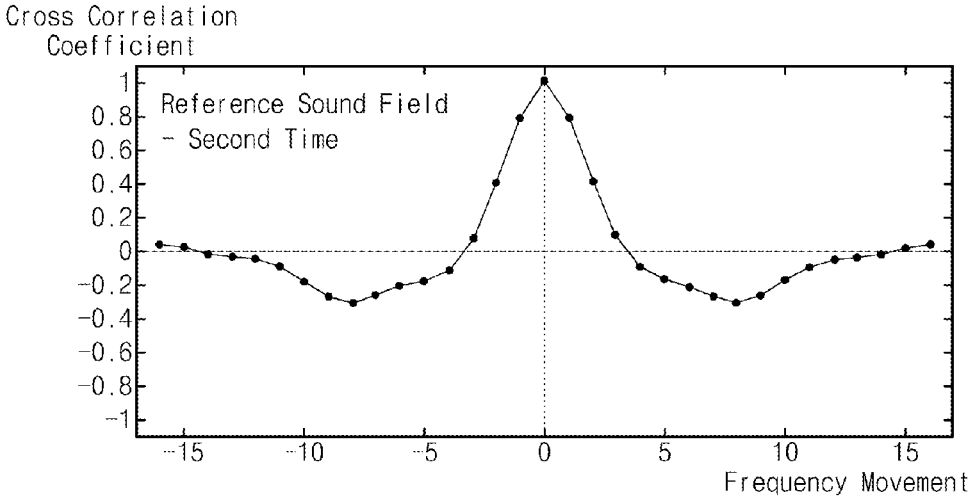
FIGS. 8*a* to 8*c* are views respectively representing cross correlation coefficient variations of second, sixth, and tenth measurements, obtained by adopting, as a variable, a frequency movement index between a reference sound field value and each of consecutive measurement values in the sound field spectra obtained from FIG. 7.
Figure 8B:
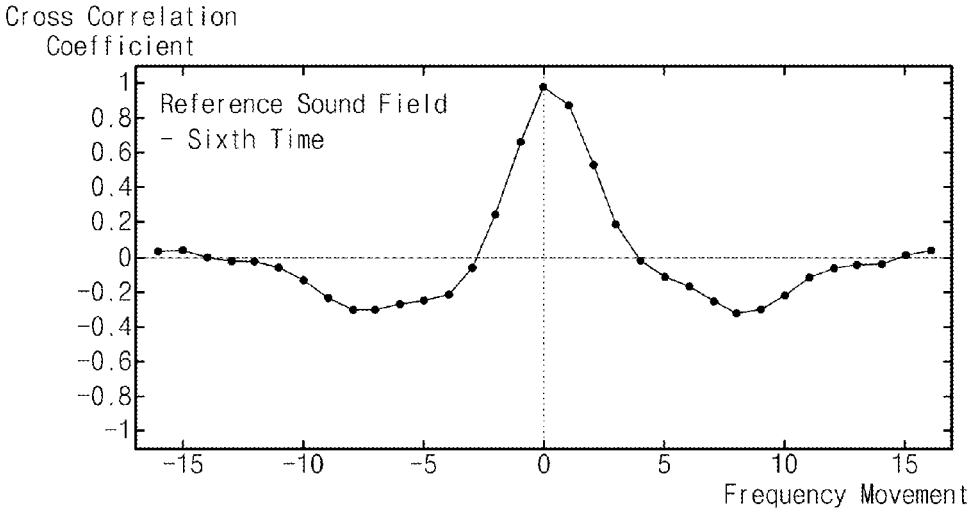
Figure 8C:
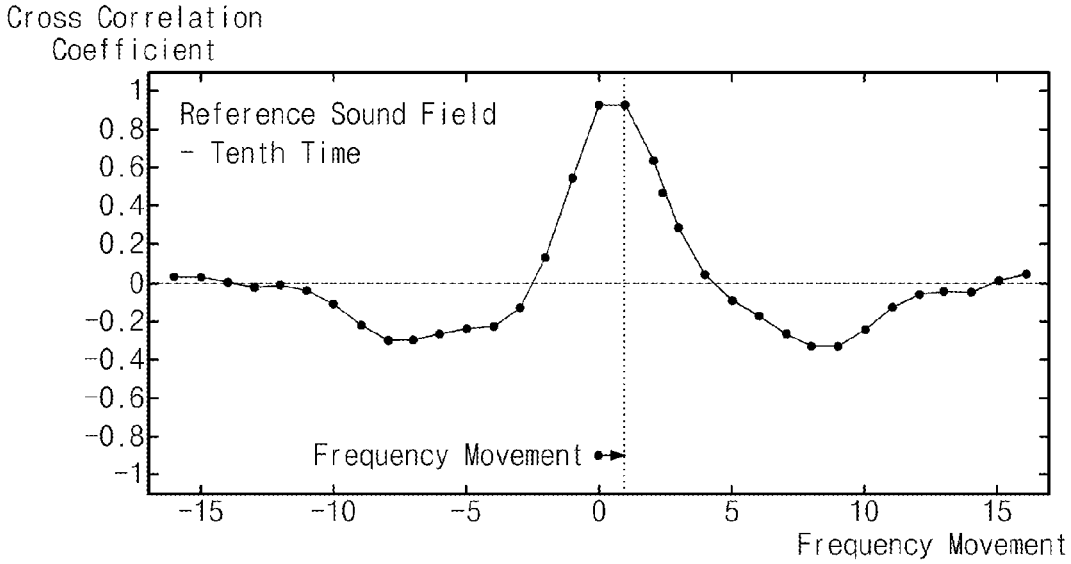

FIGS. 8*a* to 8*c* are views respectively representing cross correlation coefficients obtained by adopting, as a variable, a frequency movement between the reference sound field spectrum and each of secondly, sixthly, and tenthly measured sound field spectra. Referring to FIGS. 8*a* to 8*c*, the cross correlation coefficient is gradually differed in comparison to the intrusion case shown in FIGS. 3*a* to 3*c*. For FIG. 3*c*, a maximum coefficient of cross correlation of the reference sound field spectrum with tenth measurement appear at m=1. This is the same result as that obtained from a case where the sound field spectrum shown in FIG. 7 is moved towards a high frequency by about 4 Hz.

Figure 9:
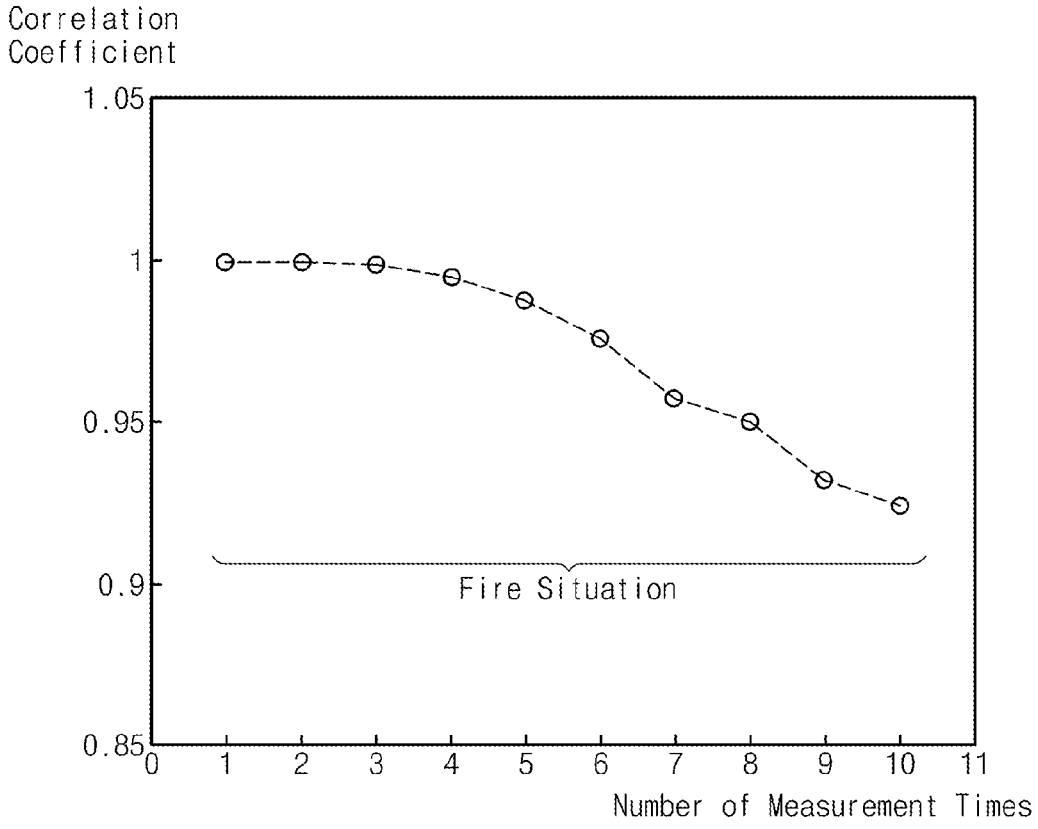
FIG. 9 is a view representing a correlation coefficient without frequency movement (m=0) between the reference sound field measurement value and each of consecutive measurement values in the sound field spectra obtained from FIG. 7.

FIG. 9 is a view representing a correlation coefficient variation according to the number of measurement times when m=0 without a frequency movement. Referring FIG. 9, the correlation coefficient is gradually decreased around 1 in comparison to the intrusion case, as shown in FIG. 4. This means that the sound field spectrum gradually moves towards a high frequency along a temperature increase.

Figure 10:
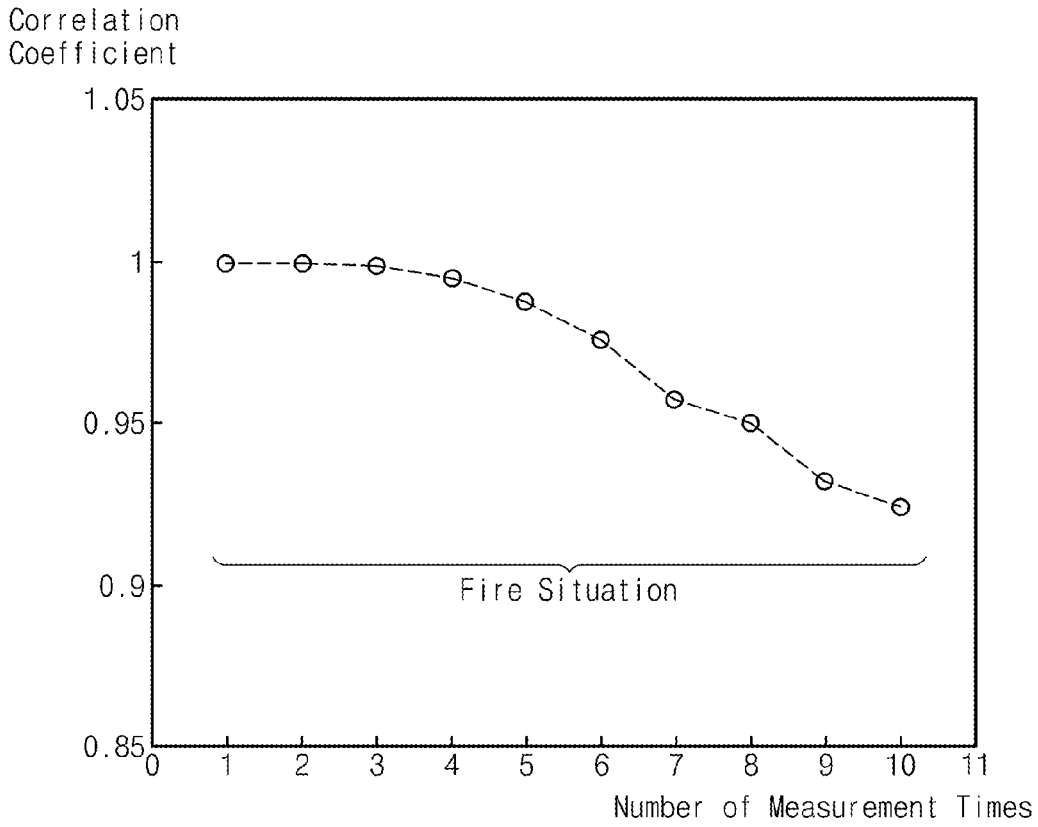
FIG. 10 is a view representing, for each measurement time, a maximum value of a cross correlation coefficient obtained in consideration of a frequency movement between reference sound field measurement value and each of consecutive measurement values in the sound field spectra obtained from FIG. 7.

FIG. 10 is a view representing, for each measurement time, a maximum value of cross correlation coefficients obtained in consideration of a frequency movement between a reference sound field measurement value and consecutive measurement values in the sound field spectra obtained from FIG. 7. This represents that all cases of frequency movement are considered when m is not 0 as shown in FIG. 5. The cross correlation coefficient becomes a maximum when the frequency moves by about 4 Hz when tenth measurement is made as shown in FIG. 8. Accordingly, the correlation coefficient at the tenth measurement is different for cases of FIGS. 9 and 10 but a difference thereof is not large.

Figure 11:
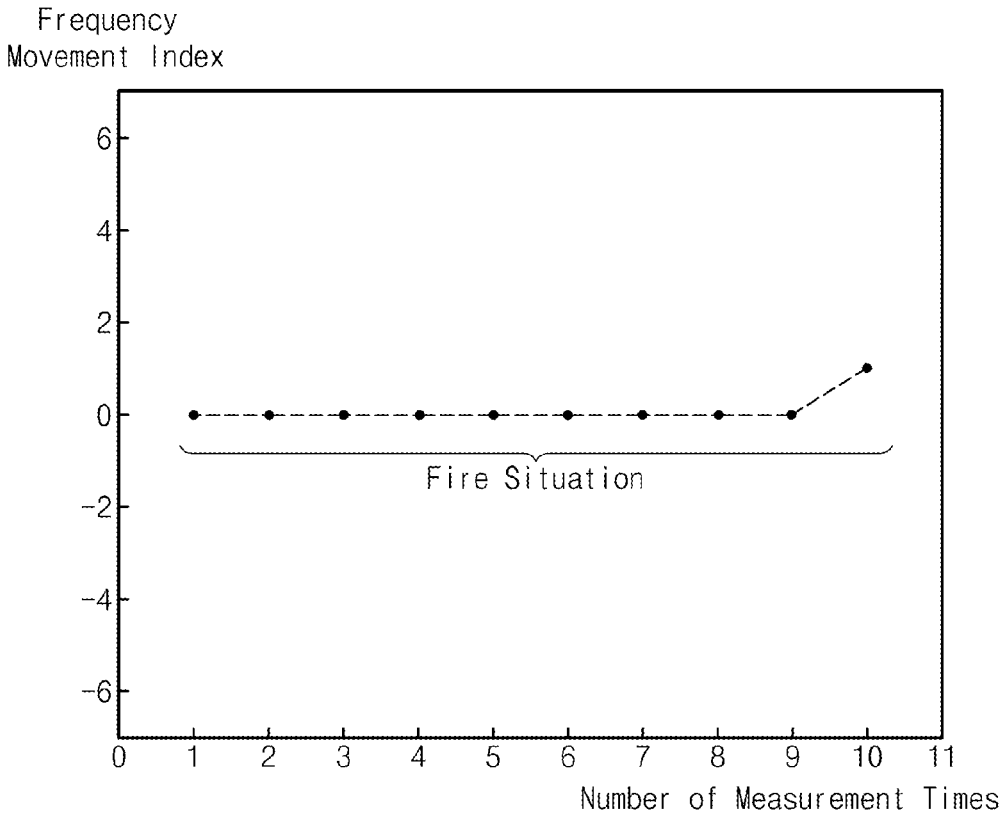
FIG. 11 is a view representing for each measurement time, a frequency movement index corresponding to a maximum value of a correlation coefficient in order to represent how far a spectrum moves in frequency in consecutive measurement in comparison to a reference sound field in the sound field spectra of FIG. 7.

FIG. 11 is a view representing for each number of measurement times, a frequency movement index corresponding to a maximum value of a correlation coefficient in order to represent how far a spectrum moves in frequency in consecutive measurement in comparison to the reference sound field in the sound field spectra of FIG. 7. Referring to FIG. 11, a frequency movement value of which the cross correlation coefficient becomes a maximum is moved towards a high frequency by about 4 Hz only at tenth measurement.

Furthermore, FIGS. 12 to 21 are views related to experiment results when the reference sound field spectrum is measured by using a signal of which a central frequency is about 6 KHz, which is slightly higher, and then a sound field spectrum is consecutively measured 15 times with a time interval of 8 seconds. In this case, the sound field spectrum results are analyzed which are obtained by generating, by the sound generating device 110, a sound source having the frequency interval of about 4 Hz and frequencies of all 17 channels for 0.5 second, and frequency filtering, by the sound field signal processing device 130, a sound signal received by the sound receiving device 120.

Figure 12:
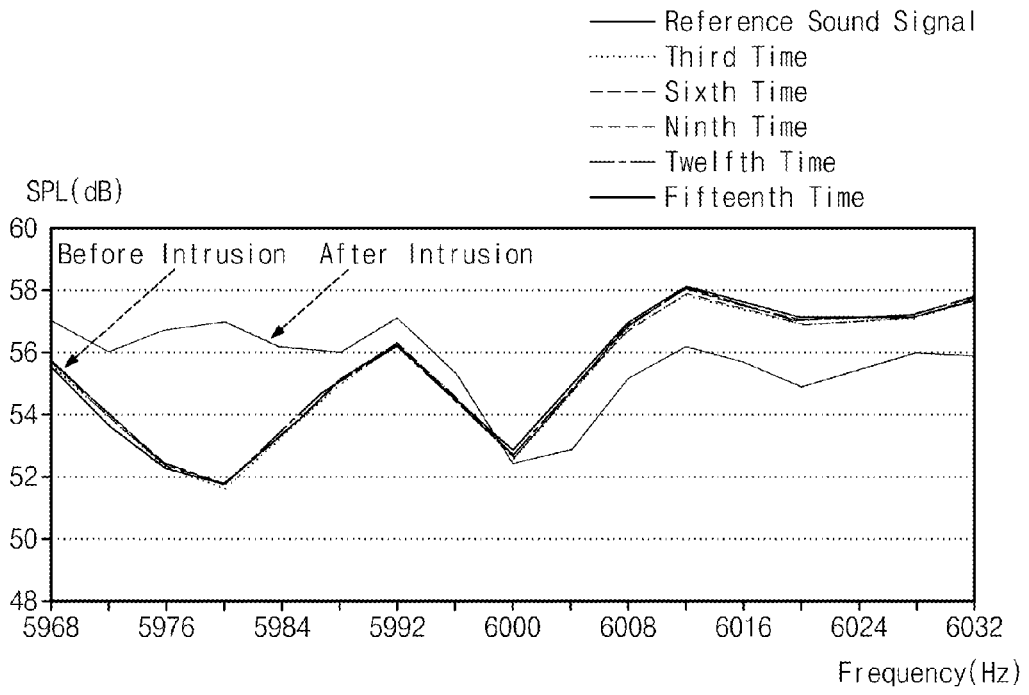
FIG. 12 is a view representing a sound field spectrum variation appeared when an abrupt intrusion situation occurs (fifteenth measurement) in measurements of the reference sound field and consecutive sound fields by using a multi-tone sound source having a central frequency of 6 kHz and a frequency interval of 4 Hz.

FIG. 12 is a view representing a sound field spectrum variation appeared when an abrupt intrusion situation occurs (the fifteenth) in measurements of reference sound field and consecutive sound fields by using a multi-tone sound source having a central frequency of 6 kHz and a frequency interval of 4 Hz. Referring to FIG. 12, the sound field spectrum is rapidly varied at the time of the fifteenth measurement when the intrusion situation occurs.

Figure 13A:
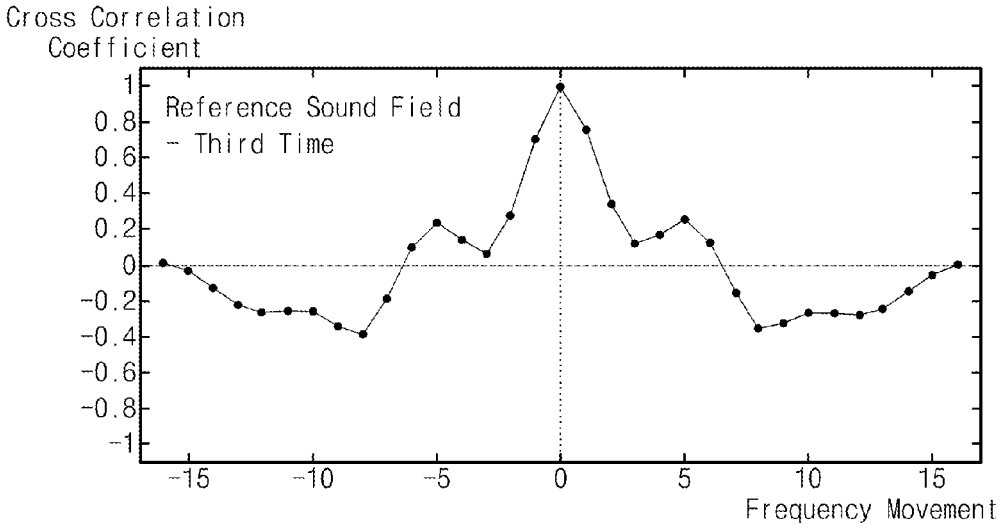
FIGS. 13*a* to 13*c* are views respectively representing cross correlation coefficient variations of third, ninth, and fifteenth measurements, obtained by adopting, as a variable, a frequency movement index between a reference sound field measurement value and each of consecutive measurement values in the sound field spectra obtained from FIG. 12.
Figure 13B:
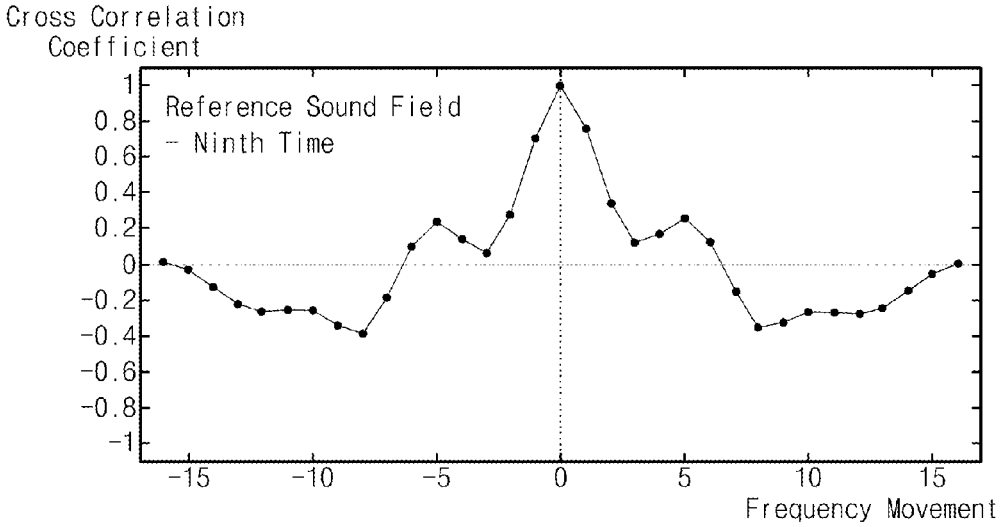
Figure 13C:
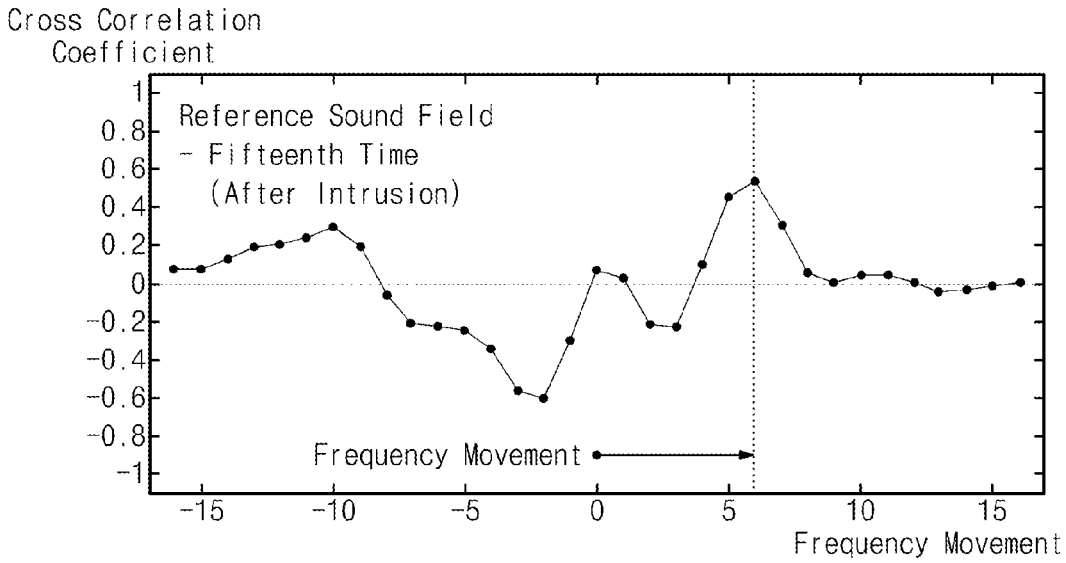

FIGS. 13*a* to 13*c* are views respectively cross correlation coefficient variations of third, ninth, and fifteenth measurements, obtained by adopting, as a variable, a frequency movement index between the reference sound field spectrum and each of thirdly, ninthly, and fifteenthly measured sound field spectra in the sound field spectra obtained from FIG. 12. Referring to FIGS. 13*a* to 13*c*, a rapid variation occurs in the fifteenth measurement when the intrusion situation occurs in representing cross correlation coefficients between the reference sound field spectrum and the third, ninth, and fifteenth measurements.

Figure 14:
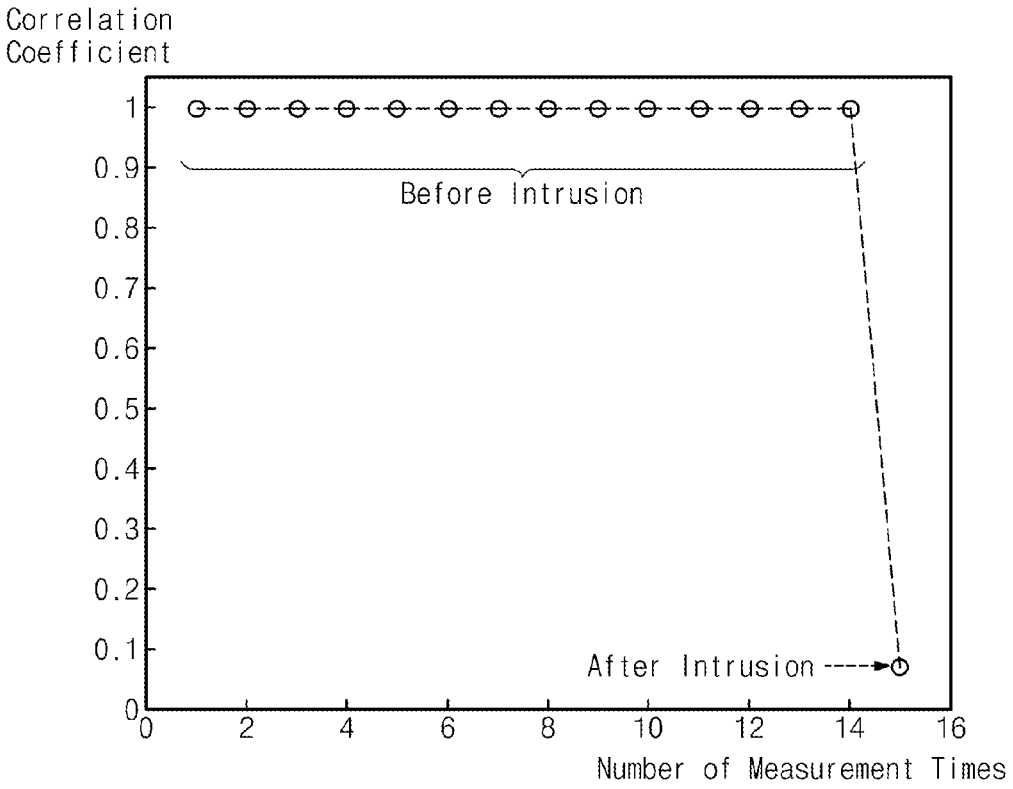
FIG. 14 is a view representing correlation coefficients without frequency movement (m=0) between the reference sound field measurement value and each of consecutive measurement values in the sound field spectra obtained from FIG. 12.

FIG. 14 is a view representing correlation coefficients without frequency movement (m=0) between a reference sound field measurement value and consecutive measurement values in the sound field spectra obtained from FIG. 12. Referring to FIG. 14, although a correlation coefficient approaches almost 1 and has no change before the intrusion when m=0 without a frequency movement, the correlation coefficient is rapidly decreased and measured as smaller than about 0.1 at the fifteenth measurement when the intrusion situation occurs. This represents that the sound field spectrum in occurrence of the intrusion situation is completely different in comparison to the reference sound field spectrum.

Figure 15:
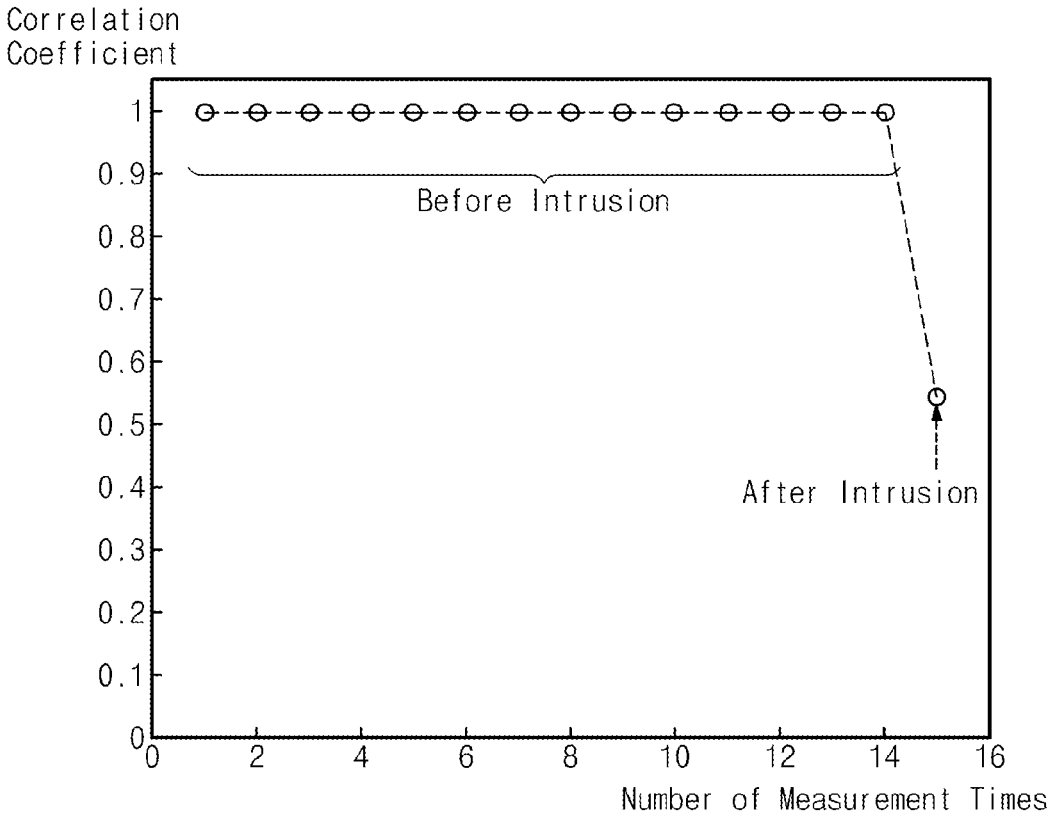
FIG. 15 is a view representing, for each measurement time, a maximum value of a cross correlation coefficient obtained in consideration of a frequency movement between a reference sound field measurement value and each of consecutive measurement values in the sound field spectra obtained from FIG. 12.

FIG. 15 is a view representing, for each measurement time, a maximum value of cross correlation coefficients obtained in consideration of frequency movements between a reference sound field measurement value and consecutive measurement values in the sound field spectra obtained from FIG. 12. Referring FIG. 15, a maximum value of the cross correlation coefficients obtained by considering all cases including a case where m is not 0 in consideration of frequency movement is between about 0.5 to about 0.6.

Figure 16:
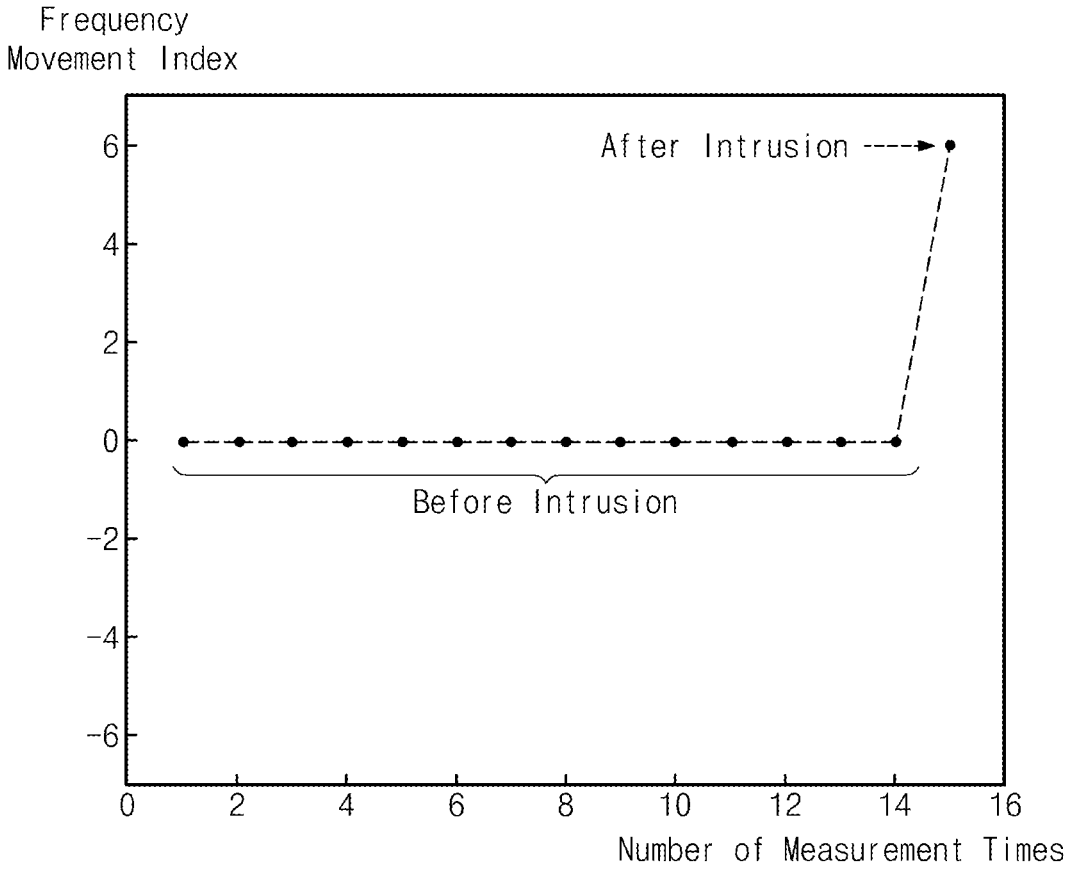
FIG. 16 is a view representing for each measurement time in a monitoring mode, a frequency movement index corresponding to a maximum value of a correlation coefficient in order to represent how far a spectrum moves in frequency in consecutive measurement in comparison to the reference sound field in the sound field spectra of FIG. 12.

FIG. 16 is a view representing for each measurement time in a monitoring mode, a frequency movement index corresponding to a maximum value of a correlation coefficient in order to represent how far a spectrum moves in frequency in consecutive measurement in comparison to the reference sound field in the sound field spectra of FIG. 12. Referring FIG. 16, a frequency movement index m corresponding to this is 6, and the frequency movement index does not represent that an actual sound field spectrum moves in frequency because the cross correlation coefficient is not large despite of considering the frequency movement. This is because the frequency movement index does not have an important meaning unlike the fire situation where the sound field spectrum moves towards a high frequency.

Figure 17:
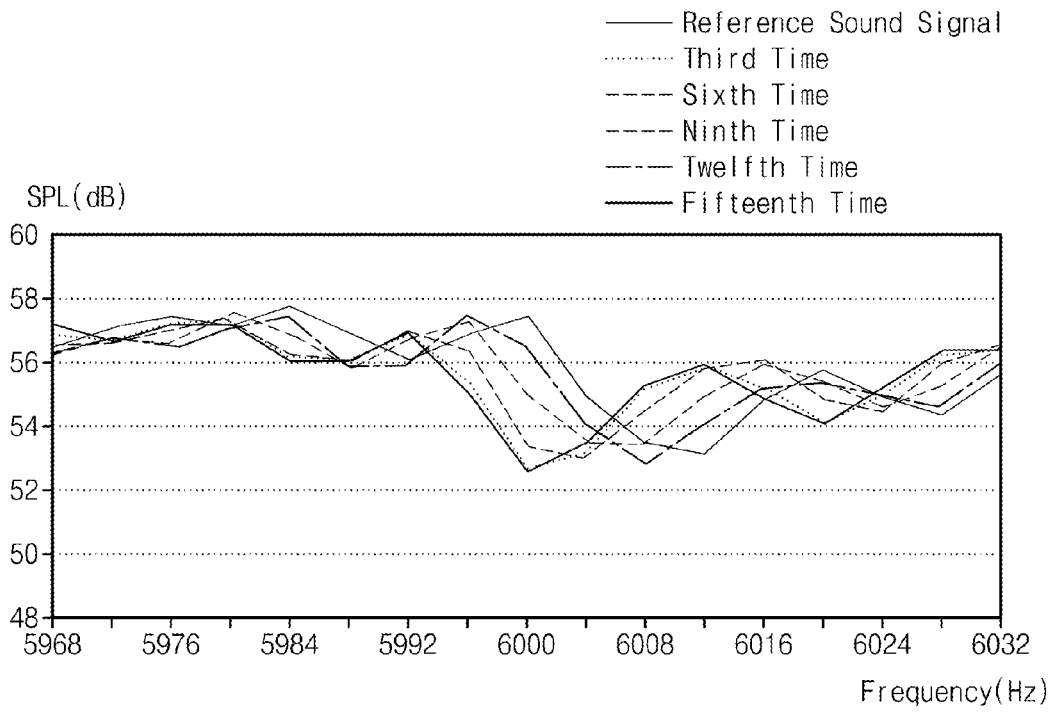
FIG. 17 is a view representing a gradual variation of a sound field spectrum appeared when a temperature variation caused by a fire situation occurs from the beginning time in measurements of the reference sound field and consecutive sound fields by using a multi-tone sound source having a central frequency of 6 kHz and a frequency interval of 4 Hz.

FIG. 17 is a view representing a gradual variation of a sound field spectrum appeared when a temperature variation caused by a fire situation occurs from the beginning time in measurements of reference sound field and consecutive sound fields by using a multi-tone sound source having a central frequency of 6 kHz and a frequency interval of 4 Hz. Referring to FIG. 17, it may be seen that when a fire situation occurs from a first measurement, the sound field spectrum gradually moves towards a high frequency from the first to fifteenth measurement.

Figure 18A:
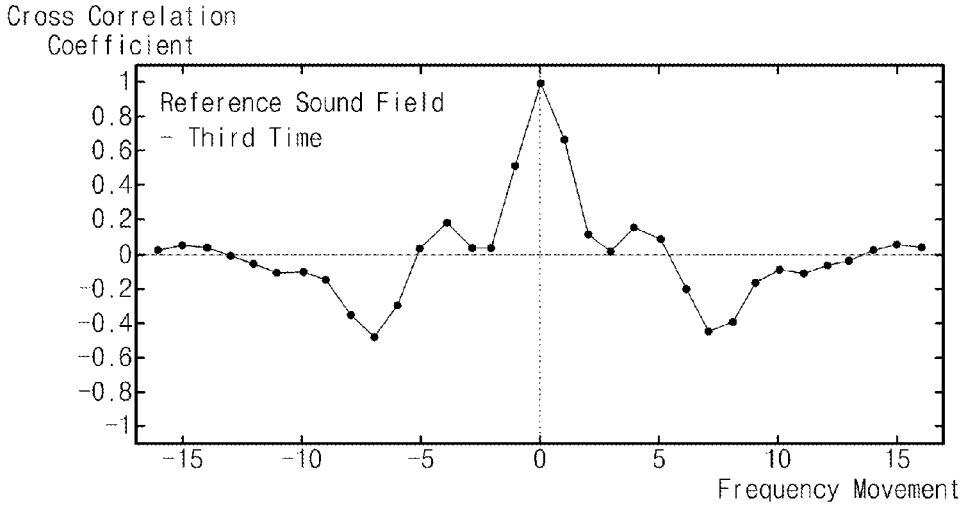
FIGS. 18*a* to 18*c* are views respectively representing cross correlation coefficient variations of third, ninth, and fifteenth measurements, obtained by adopting, as a variable, a frequency movement index between a reference sound field measurement value and each of consecutive measurement values in the sound field spectra obtained from FIG. 17.
Figure 18B:
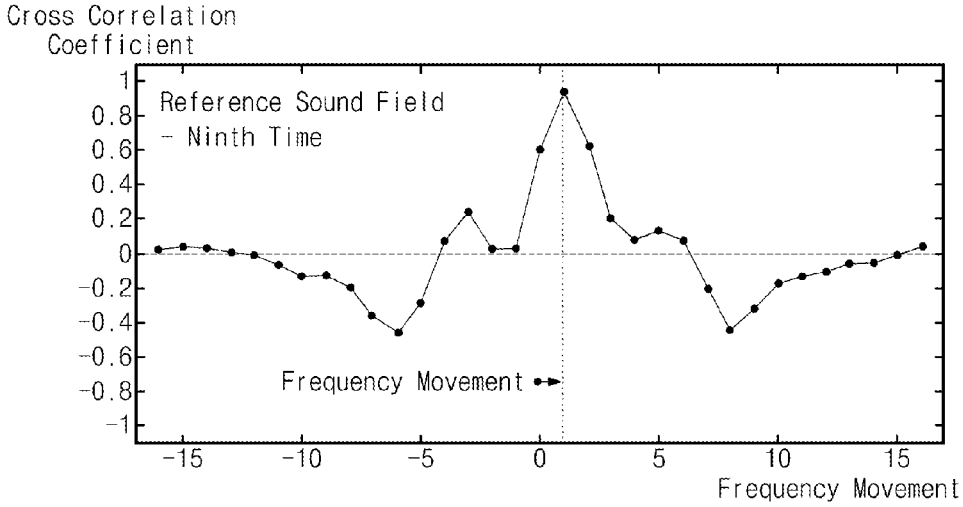
Figure 18C:
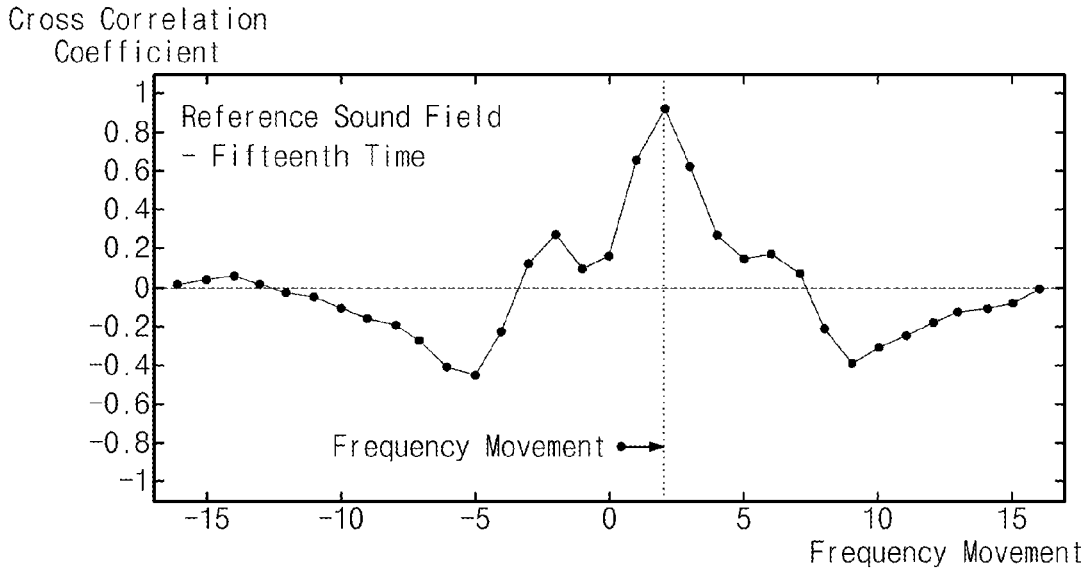

FIGS. 18*a* to 18*c* are views respectively representing cross correlation coefficient variations of third, ninth, and fifteenth measurements, obtained by adopting, as a variable, a frequency movement index between a reference sound field measurement value and consecutive measurement values in the sound field spectra obtained from FIG. 17. Referring to FIG. 18, from cross correlation coefficients between the reference sound field spectrum and the third, ninth and fifteenth measurements, it may be seen that a frequency movement index corresponding to a maximum value gradually increases.

Figure 19:
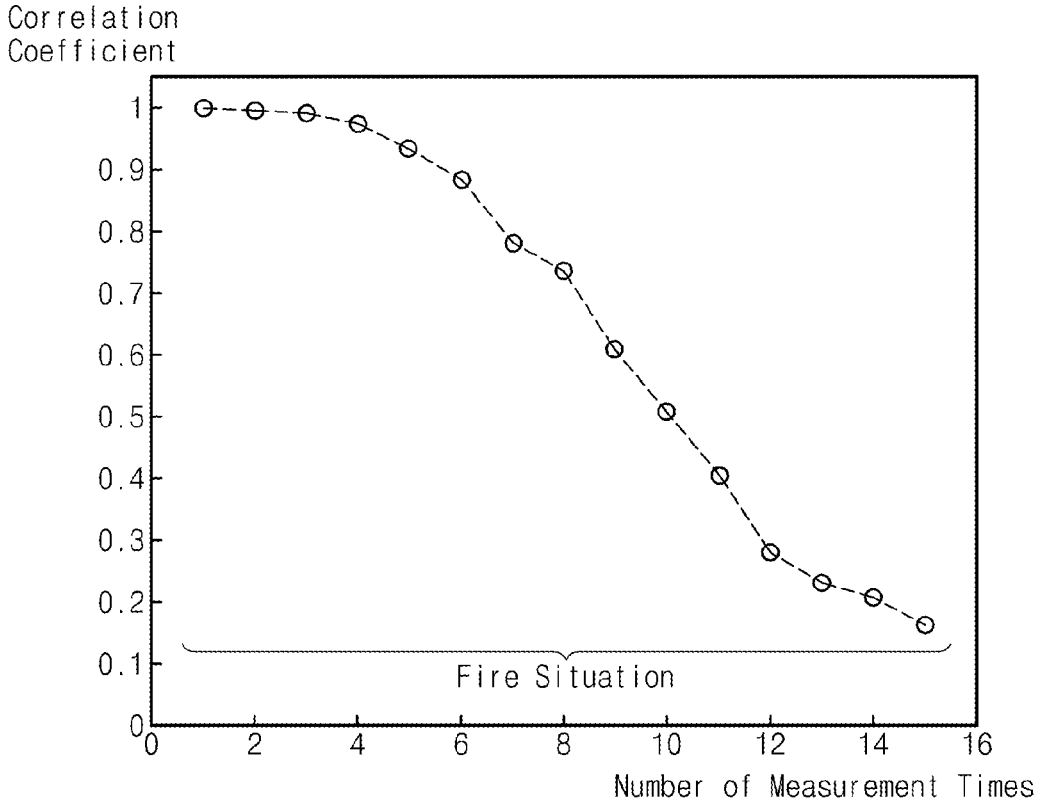
FIG. 19 is a view representing correlation coefficients without frequency movement (m=0) between the reference sound field measurement value and each of consecutive measurement values in the sound field spectra obtained from FIG. 17.

FIG. 19 is a view representing correlation coefficients without frequency movement (m=0) between a reference sound field measurement value and consecutive measurement values in the sound field spectra obtained from FIG. 17. Referring to FIG. 19, a correlation coefficient in a case where m=0 without frequency movement approaches almost 1 at an initial stage of occurrence of a fire situation, but as time passes, the correlation coefficient becomes smaller and is decreased between about 0.1 to about 0.2 at the fifteenth measurement.

Figure 20:
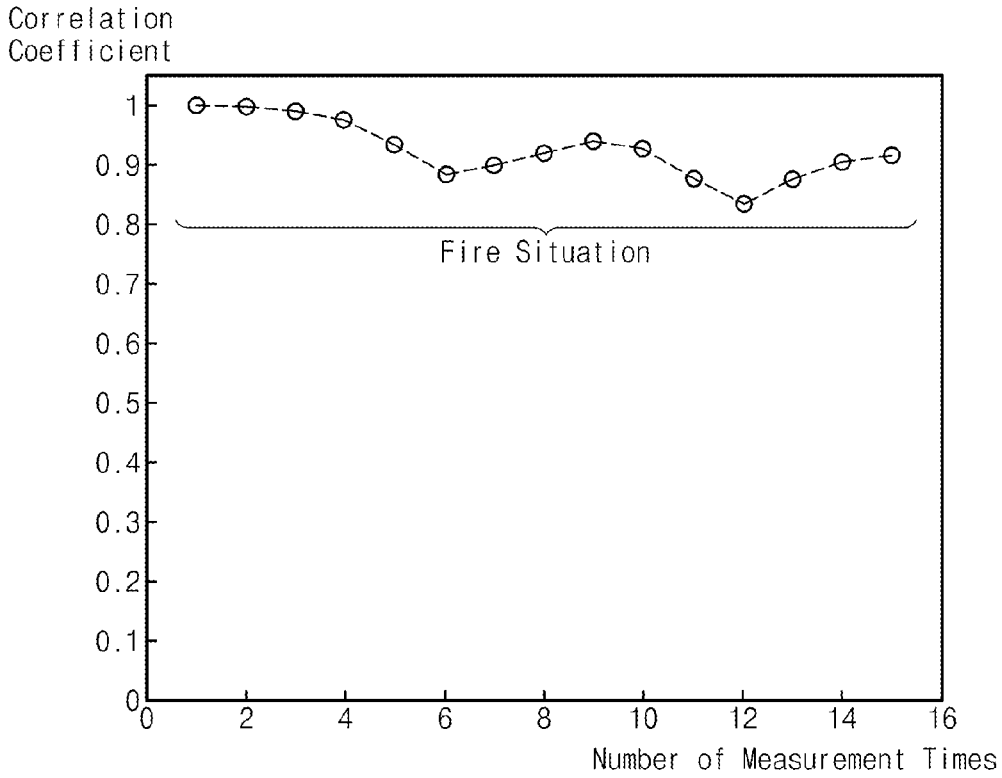
FIG. 20 is a view representing, for each measurement time, a maximum value of a cross correlation coefficient obtained in consideration of a frequency movement between a reference sound field measurement value and each of consecutive measurement values in the sound field spectra obtained from FIG. 17.

FIG. 20 is a view representing, for each measurement time, a maximum value of cross correlation coefficient obtained in consideration of a frequency movement between a reference sound field measurement value and consecutive measurement values in the sound field spectra obtained from FIG. 17. Referring FIG. 20, a maximum value of the cross correlation coefficients, which is obtained by considering all cases including a case where m is not 0 in consideration of frequency movement, periodically varies between about 0.8 to about 1.

Figure 21:
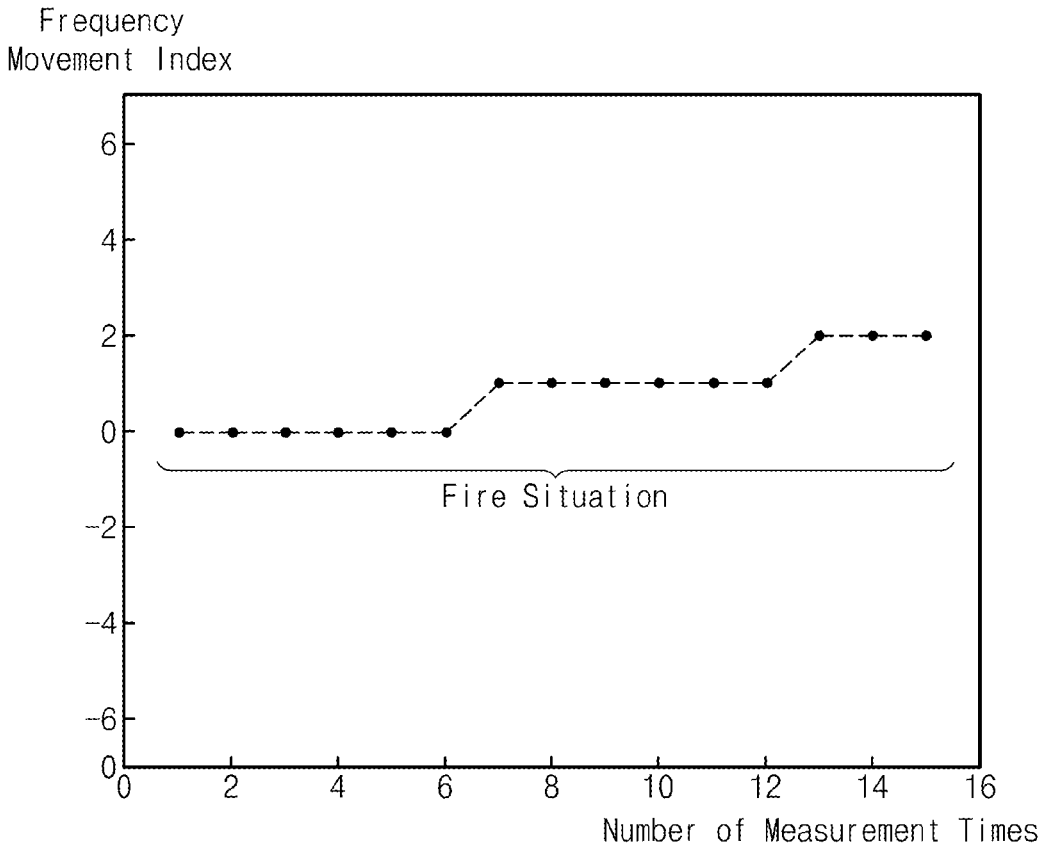
FIG. 21 is a view representing for each measurement time in a monitoring mode, a frequency movement index corresponding to a maximum value of a correlation coefficient in order to represent how far a spectrum moves in frequency in consecutive measurement in comparison to the reference sound field in the sound field spectra of FIG. 17.

FIG. 21 is a view representing for each measurement time in a monitoring mode, a frequency movement index corresponding to a maximum value of a correlation coefficient in order to represent how far a spectrum moves in frequency in consecutive measurement in comparison to a reference sound field in the sound field spectrum of FIG. 17. Referring to FIG. 21, it may be seen that the frequency movement index m is gradually increased as 0 from the first to sixth measurements, 1 from the seventh to twelfth measurements, and 2 from the thirteenth to fifteenth measurements. In consideration of frequency movement, the cross correlation coefficient approaches 1. Therefore, the frequency movement index represents that an actual sound field spectrum moves towards a high frequency and accordingly, it may be reliable that there is a temperature variation. When the central frequency increases, an amount of the frequency movement is increased. The following description pertains to a security monitoring method using a variation pattern of correlation coefficients between sound field spectra implemented through such a sound field measurement.

The security monitoring method according to an embodiment of the present invention calculates cross correlation coefficients between the reference sound field and consecutive sound fields for the pre-determined number of times in a sound field spectrum obtained through consecutive measurements, monitoring a correlation coefficient for a case that m=0 without frequency movement, and when the correlation coefficient is smaller than a pre-determined reference value that is smaller than 1 and larger than −1, determines a security situation such as intrusion or fire occurs. The correlation coefficient is a criterion that a correlation for determining how much two spectra are similar is quantified. The determination criterion value may be determined to a certain value of smaller than 1 and larger than −1 according to an environment or a condition. In an embodiment of the present invention, the determination criterion value may be determined, but is not limited, to about 0.95.

In another embodiment, the security monitoring method does not use a correlation coefficient value representing a degree of how much the sound field spectra are similar, calculate a value that the correlation coefficient is subtracted from 1 as an index representing how much they are different, and compares two values obtained from the reference sound field and consecutive current sound fields to determine occurrence of a dangerous situation. A method may be used which determines a dangerous situation with a ratio of a value obtained by subtracting from 1 a correlation coefficient obtained by measuring a sound field the pre-determined number of times at an initial stage and a value obtained by subtracting from 1 a correlation coefficient between a current sound field and an initial sound field. Similar to an existing method of detecting a sound field variation by using a reference deviation (namely, noise) and signal of a sound field, the method may be applied which determines a dangerous situation by comparing an average and deviation of indexes representing a degree of difference of initial measurements and indexes representing a degree of difference of current sound field measurements. Compared to the existing method, this method may greatly improve reliability and sensitivity.

In order to improve reliability and minimize a malfunction problem of sound field security, which may occur due to instantaneously wrong data of a sound field value due to external noise or electric noise of acoustic devices, a security monitoring method according to another embodiment of the present invention may add an operation of checking a sound field variation due to occurrence of a dangerous situation by repeating sound field measurement or increasing the size of a sound source to re-measure a sound transfer function. Since the correlation coefficient uses a relative deviation from an average regardless of the absolute amplitude of a sound field, when a sound source is very large in comparison to surrounding environmental noise, the correlation coefficient may have an identical value regardless of the amplitude of the sound source. Accordingly, when the correlation coefficient is obtained, an identical result may be obtained regardless of an amplitude variation of the sound source by using a sound pressure level of a sound receiving device itself without variation, other than a sound transfer function that a voltage applied to a sound generating device is considered.

Since a sound field spectrum may be sensitively varied by an ordinary temperature variation such as daily temperature range, air conditioning and heating as well as intrusion and fire, it is difficult to accurately distinguish a security situation with simple measurement of correlation coefficient without considering a frequency movement. Firstly, for solving this, it is necessary to distinguish a situation where a sound field varies very rapidly like intrusion from a situation where a sound field gradually varies like a temperature variation such as fire, daily temperature range, and air conditioning and heating. For the intrusion, as shown in FIG. 4, a uniform correlation coefficient is maintained before the intrusion, and when the intrusion occurs, the correlation coefficient is very rapidly decreased. For fire and ordinary temperature variation, as shown in FIG. 9, the correlation coefficient is gradually decreased.

In order to distinguish a variation pattern of a correlation coefficient according to a time variation, a security monitoring method according to an embodiment of the present invention uses a comparison between an average value $R_a$ of the correlation coefficients of the pre-determined number of times in a uniform interval before a time point when the correlation coefficient becomes smaller than a reference value due to intrusion or temperature variation and a correlation coefficient $R_b$ at the time point when a dangerous situation such as intrusion or fire occurs. For concrete and quantitative comparison, the following Equation (8) may be used.

$$V=(1-R_b)/(1-R_a) \tag{8}$$

This ratio represents how many times a reference sound field differs from a sound field at a time point when a security situation occurs in comparison to an average difference between the reference sound field and a sound field of a certain period before the security situation occurs. V value of Equation (8) has a meaning of an index representing how much a sound field rapidly varies at a time point of final sound field variation detection.

For example, for a case of intrusion, since $R_a$ and $R_b$ shown in FIG. 4 are respectively 0.9995 and 0.9103, an index value V representing a degree of rapid variation of the correlation coefficient is 193.37. For a case of temperature change, since $R_a$ and $R_b$ shown in FIG. 9 are respectively 0.9774 and 0.9247, the V value corresponds to 3.33, which shows very large difference. Accordingly, an intrusion situation may be distinguished from a temperature variation situation by determined a certain reference value.

However, in an ordinary environment, a case where an intrusion situation and a temperature variation situation co-exist may occur, or intrusion or motion of a small object having a degree that a sound field variation is not detectable in a predetermined measurement period and a temperature variation may simultaneously appears. In a certain case, these two situations may sequentially occur and a sound field variation may be detected. In a case where a sound field variation is detected by a slight motion of the object that is finally considered as intrusion in a state where a temperature variation occurs, a condition is about 6 where a variation value of a correlation coefficient due to intrusion has greater importance than a variation value of a correlation coefficient due to fire. Accordingly, it may be determined as fire when V is smaller than 6, and intrusion when V is greater than 6. However, the present invention is not limited to this value. V respectively becomes 376.61 and 2.63 in the intrusion situation of FIG. 14 and the temperature variation situation of FIG. 19.

In order to improve reliability and minimize a malfunction problem of sound field security, which may occur due to instantaneously wrong data of a sound field value due to external noise or electric noise of acoustic devices, a security monitoring method according to an embodiment of the present invention may add an operation of rechecking a sound field variation due to occurrence of a dangerous situation by repeating sound field measurement or increasing the size of a sound source to re-measure a sound transfer function. Through this, an operation is executed which re-measures a reference sound field after improving accuracy of intrusion detection and accurately checking a safe situation.

In a security monitoring method according to an embodiment of the present invention, an alarm informing an intrusion situation is delivered and a dangerous situation is dealt with through imaging, storing, and transmitting an image of a security space. However, in a case of being determined as a temperature variation situation, succeeding processes are required because an ordinary temperature situation such as fire, daily temperature range, and air conditioning and heating is to be distinguished. In this case, the temperature variation situation may be determined by distinguishing whether a frequency movement of a sound field spectrum occurs towards a high frequency or a low frequency, and whether the frequency movement lasts for a long time.

In a case of temperature increase, as shown in FIGS. 11 and 21, the frequency movement index moves in a high frequency direction. In a case of temperature decrease, the frequency movement index moves in a low frequency direction. In addition, when a temperature increase is determined to be continued through repetitive measurements in a certain period, whether this phenomenon is continued is monitored through succeeding repetitive measurements and whether the temperature increase is ordinary and temporary due to heating or daily temperature range or is continuous due to fire.

As described above, a sound field variation pattern detection based security monitoring method using a correlation coefficient of a sound field spectrum according to an embodiment of the present invention may distinguishably detect a dangerous situation of security at the initial stage of the intrusion situation or fire situation, and may issue an alarm according to the intrusion or fire situation. In addition, in a case of interacting with a camera module such as a CCTV, the security monitoring system may store a captured image related to the intrusion or fire situation or transmit the captured image to a set destination. Here, the destination may be a vehicle remote controller, a smart device such as a smart phone and a tablet PC of a specific person, a guard house server, a security company server, a fire station server, or a police station server.

Figure 22:
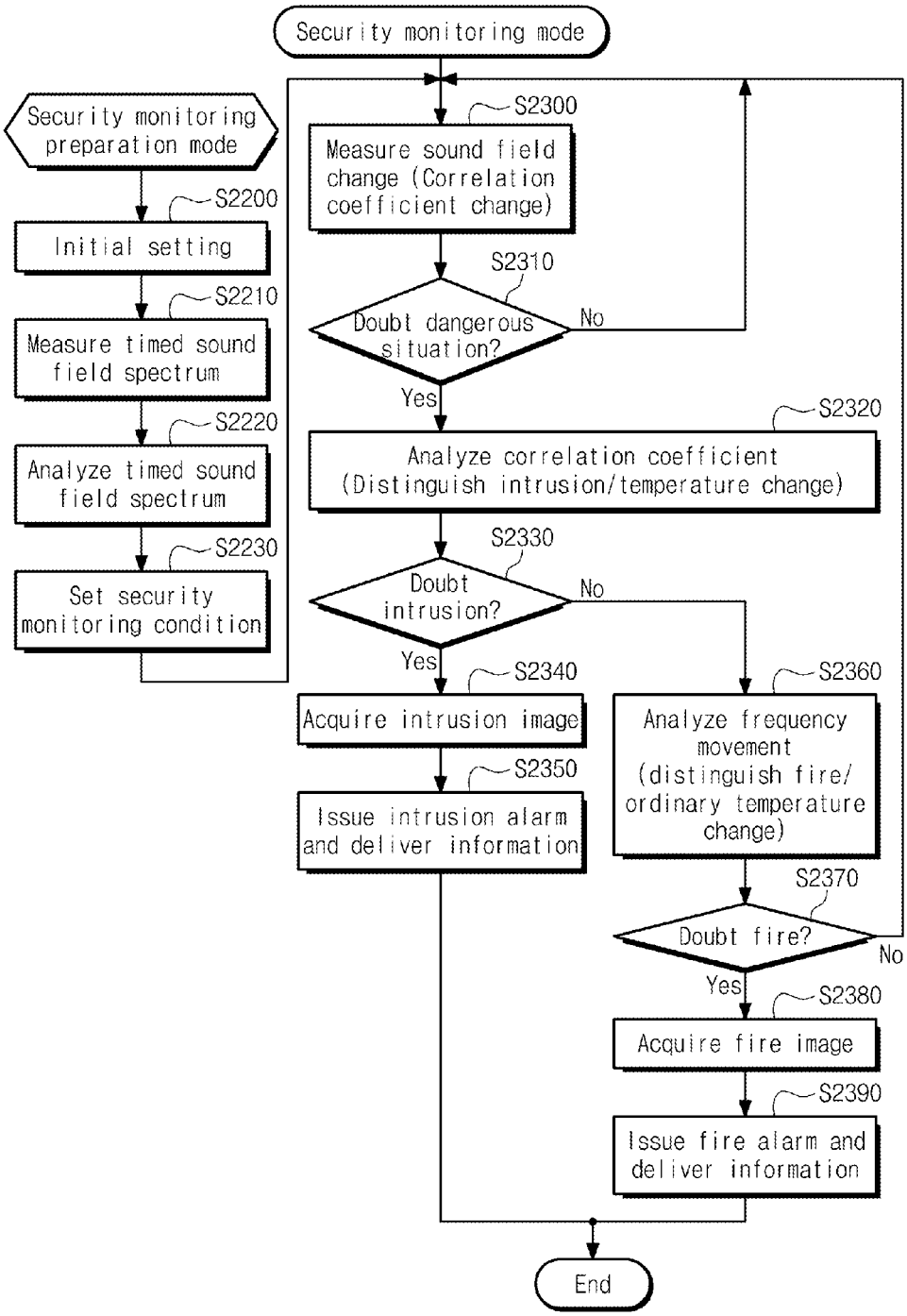
FIG. 22 is a flow chart of a security monitoring operation for distinguishing to detect intrusion, fire, and an ordinary temperature variation on the basis of a correlation coefficient of a sound field spectrum.

FIG. 22 is a flow chart of a security monitoring operation for distinguishing to detect intrusion, fire, and an ordinary temperature variation on the basis of a correlation coefficient of a sound field spectrum.

The operation shown in FIG. 22 may be implemented by an operation execution of the sound field signal processing device 130 of FIG. 1, and distinguishably detect intrusion and fire, and an ordinary temperature variation situation such as daily temperature range and air conditioning and heating on the basis of sound field pattern variation detection using a correlation coefficient of a sound field spectrum. Referring to FIG. 22, a security monitoring method according to an embodiment of the present invention is largely divided into a preparation mode and a monitoring mode.

The preparation mode may include an operation S2200 of initial setting, an operation S2210 of measuring a sound field spectrum according to time, an operation S2220 of analyzing the sound field spectrum according to time, and an operation S2230 of setting a security monitoring condition.

The monitoring mode may include an operation S2300 of measuring a sound field spectrum variation for measuring a correlation coefficient variation, an operation of S2310 for determining whether a dangerous situation occurs, an operation S2320 of distinguishing an intrusion/temperature variation through correlation coefficient analysis, an operation S2330 of determining an intrusion situation, an operation S2340 of acquiring an intrusion image, an operation S2350 of issuing an intrusion alarm and delivering information, an operation S2360 of distinguishing a fire/ordinary temperature variation by analyzing a frequency movement index, an operation S2370 of determining a fire situation, an operation S2390 of acquiring a fire image, and an operation S2390 of issuing and delivering a fire alarm.

In operation S2200 of initial setting, the sound generating device 110 operates and a sound wave is output in a security monitoring space according to a certain input voltage. In addition, the sound receiving unit 120 operates and the sound wave in the security monitoring space is received. The sound field signal processing device 130 obtains a sound field spectrum of reference sound field information (amplitude of sound pressure and a phase) for each frequency using data from the sound receiving device 120. Calculated information is stored in an internal memory.

In operation S2210 of measuring a sound field spectrum according to time, the sound field signal processing device 130 measures a sound pressure signal according to time change for each frequency and compares the measured result with the reference sound pressure spectrum information for each frequency, in order to measure the sound field spectrum according to time.

In operation S2220 of analyzing the sound field spectrum according to time, the sound field signal processing device 130 analyzes the measured sound field spectrum according to time and then store a correlation coefficient that is a sound field variation index value according to time.

In operation S2230 of setting a security monitoring condition, the sound signal processing device 130 sets an initialization time period and a reference value for determining security situation occurrence with reference to the stored correlation coefficient value according to time.

In operation 2300 of measuring a sound field variation under a security monitoring mode, the sound field signal processing device 130 measures a current sound pressure spectrum for each frequency and calculates a correlation coefficient with a reference sound field spectrum. In this case, the sound field signal processing device 130 may re-set the reference sound field spectrum in the initialization time period interval.

As another embodiment, a method may be also used that a previously measured sound field before a predetermined period from the current measurement is set as a reference sound field and the reference sound field is successively moved behind by one measurement every time a current real-time sound field is measured. Such a method has a merit in that comparison and measurement of a sound field variation are possible in an identical period where comparison is performed with a reference sound field before the designated number of times and interval. In addition, a method is selected which the initially measured sound field is fixed as the reference sound field until a certain predetermined period and extends the reference sound field to a virtual preceding sound field in a corresponding period, or a method is selected which unconditionally considers as an intrusion situation when a sound field variation occurs before measurements are completed in the designated period. Typically, this period may be set as an initialization period.

In operation S2310 of determining occurrence of a dangerous situation such as fire or intrusion, the sound field signal processing device 130 compares a current sound field spectrum according to frequency with a reference sound field spectrum according to frequency to determine whether a security situation occurs. In detail, the sound field signal processing device 130 determines that a dangerous situation occurs which causes a sound field variation when a correlation coefficient between the reference sound field spectrum and currently detected sound field spectrum is smaller than a set reference value.

In operation S2320 of analyzing a correlation coefficient of a sound field spectrum, when it is determined that the dangerous situation occurs, the sound field signal processing device 130 analyzes a variation of a correlation coefficient with a sound field spectrum in a certain predetermined period right before occurrence of the security situation. At this point, the reference sound field spectrum is re-initialized as an initial sound field spectrum before the determined period. Here, whether the sound field spectrum variation is caused by intrusion or a temperature variation may be distinguished by determining whether the correlation coefficient variations rapidly or gradually according to time. Like a method applied as an embodiment and like V in Equation (8), an index value representing a rapid variation degree of the correlation coefficient is available.

When it is determined as intrusion in operation S2330 of determining the intrusion situation, for accurately verifying this, in operation S2340 of acquiring an intrusion image, a camera module operates under a control of the sound field signal processing device 130, and image capture and image information storage is performed.

In operation S2350 of issuing an intrusion alarm and delivering information, the sound field signal processing device 130 may issue an intrusion alarm sound or deliver an intrusion alarm to a vehicle remote controller, etc. In addition, an image captured through the camera module may be transmitted to a mobile phone, smart device, or a server of a guard house, a security company, or a police station through a wired or wireless communication network. For a typical vehicle without a network function, a remote controller may be used for operating or releasing an alarm function.

When it is determined as a temperature variation situation in operation S2330 of determining intrusion, the procedure proceeds to operation S2360 of analyzing a frequency movement and a cross correlation coefficient variation is analyzed according to the frequency movement and a frequency movement index is derived. When the frequency moves in a low frequency direction, it is determined as an effect of air cooling and then operation S2300 of measuring the sound field variation is performed again since it is a normal state. On the contrary, when the frequency moves in a high frequency direction, since fire occurrence is in doubt, it is determined whether a fire situation occurs in operation S2370 on the basis of how long such a situation is continued.

In a detailed embodiment, a fire situation may be determined when a temperature increase of a higher level than a reference value is consecutively detected twice or more by repeating operation S2300 of measuring a sound field variation to operation S2330 of determining an intrusion situation, and operation S2360 of analyzing a frequency movement and operation S2370 of determining a fire situation.

When it is determined as the fire situation in operation S2370 of determining a fire situation, for accurately verifying this, in operation S2380 of acquiring a fire image, a camera module operates under a control of the sound field signal processing device 130 and capturing and image information storage is performed.

In operation S2390 of issuing a fire alarm and delivering information, the sound field signal processing device 130 may issue a fire alarm sound or deliver a fire alarm to a vehicle remote controller, etc. In addition, an image captured through the camera module may be transmitted to a mobile phone, smart device, or a server of a guard house, a security company, or a police station through a wired or wireless communication network. For a typical vehicle without a network function, a remote controller may be used for operating or releasing an alarm function. Furthermore, each operation shown in FIG. 22 may be omitted, if necessary, or another operation may be added and executed.

In an embodiment, in operation S2320 of analyzing a correlation coefficient of a sound field spectrum, when an analysis period unit of the sound field spectrum is set to a short interval of twice or three times, a rapidly changing sound field spectrum may be selectively detected. Most intrusion situations may be detected not by using a rapid variation index of Equation (8) but by simply comparing a correlation coefficient variation and distinguishing from a relatively slow temperature variation, and an intrusion situation may be selectively detected even in most temperature variation situations.

However, in this case, a detailed variation situation of the sound field spectrum due to a temperature variation may not be detected. Therefore, a method may be used which mutually compares results of sound field spectrum variation detection according to two periods conditions and accordingly distinguishes intrusion from a detailed temperature variation situation by performing a calculating operation of setting the analysis period unit of a sound field spectrum to a relatively long period to perform analysis. At this point, sensitivity of intrusion or fire detection may be adjusted by differentiating a determination reference value of a correlation coefficient variation for intrusion or fire in a short period or a long period. In addition, when it is distinguished as a temperature variation situation, a dangerous situation may be distinguished through a process of distinguishing a temperature increase from a temperature decrease for analyzing a frequency movement index.

As various use examples, a security monitoring apparatus to which such a security monitoring method is applied may be connected to an internet phone to be available in integral and external types. The security monitoring method may be also applied to various kinds of smart devices, for example, a smart phone, a smart TV, a smart vehicle, or smart appliances including a safe or an interphone such as a door-phone or a video-phone.

One or more modules having security monitoring functions may be installed inside a home, an office, a shop, a factory, and a warehouse set as a security space, and each of them may independently operate or be mutually connected in a wired or wireless manner and operate. A sound generating device and a sound receiving device are basically paired to configure a detection module in an integrated type and process a sound field signal. However, when a security space range is too wide or a structure thereof is too complex to secure reliable security monitoring using a sound field, a system configuration may be possible in a type that a plurality of pairs of sound generating and detecting devices may be connected around a system operating as a sound field signal processing device in a wired manner or through a wireless communication module such as WiFi, etc.

A noise problem may be solved by setting the apparatus to selectively operate as a multi-tone sound source, namely, to operate in the audible frequency range in a state where all humans are out and to operate in an inaudible frequency of 15 kHz or higher with a door or a window set as a sensitive security space in a situation where persons are in a limited indoor space or in sleep. Since, in the audible frequency range of 20 Hz to 15 kHz, a wavelength of a sound wave is long and there is not a blind spot due to an internal structure of the security space, wide range security monitoring is possible. In a hard to hearing or inaudible range of 15 kHz or higher, a sound wave has a short wavelength and security monitoring over a narrow area is possible.

In order to monitor indoor motions of the elderly living alone or pets, a security monitoring method according to an embodiment of the present invention also provides a method of detecting and storing sound field information in real time or transmitting a danger alarm of falling, fainting, and invalidity, etc., to a smart phone of a protector when there is no motion for a long time. In this case, a hard to hearing or inaudible range of 15 kHz or higher that a human or an animal is hard to hear may be used as a sound source.

Monitoring may be implemented in a type that motions of the elderly living alone or pets are not detected for a pre-determined time period.

Figure 23:
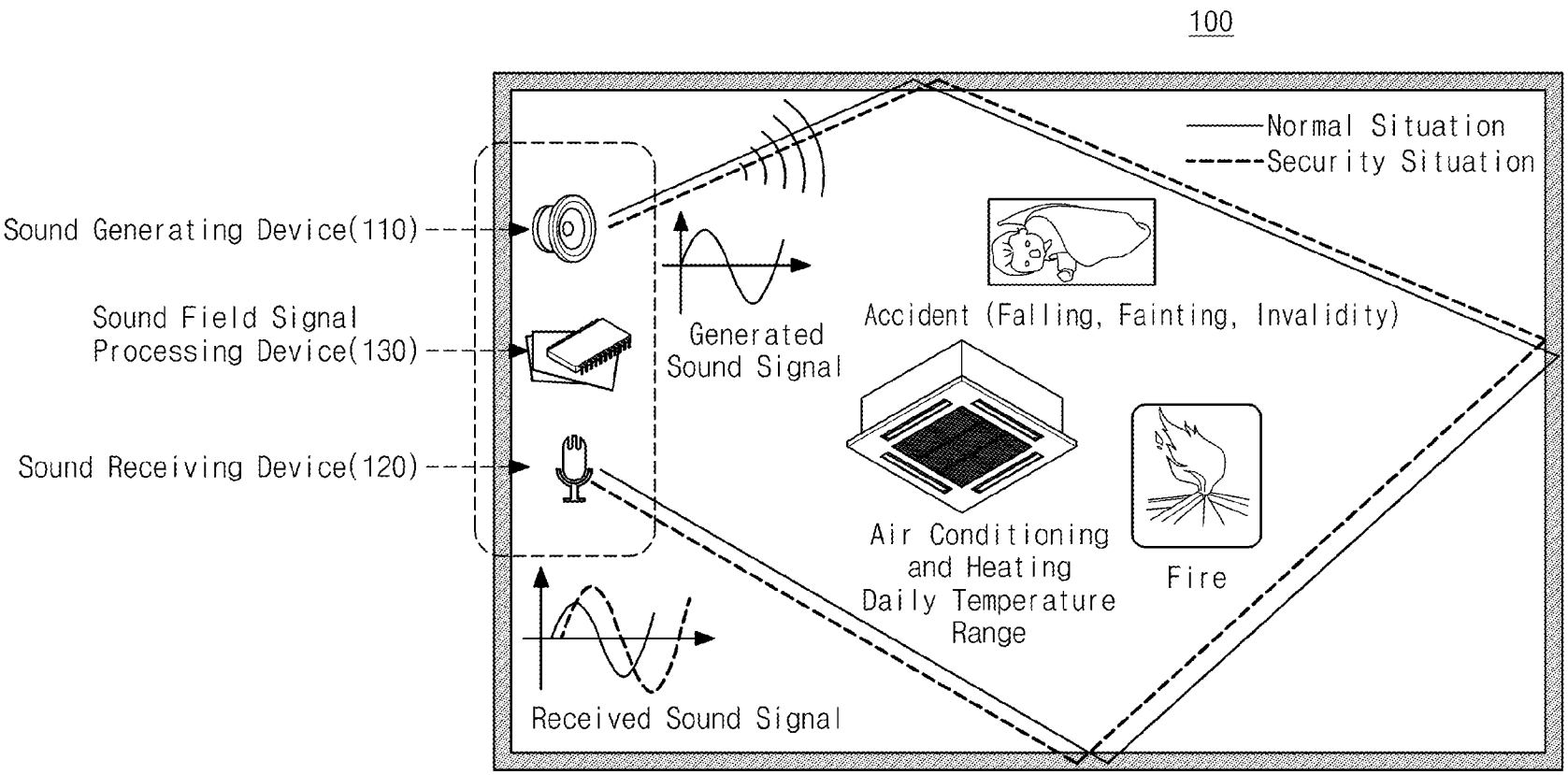
FIG. 23 is a block diagram of a dangerous situation monitoring apparatus for detecting an accident occurrence of the elderly living alone or a pet distinguishably from fire and an ordinary temperature variation situation on the basis of a correlation coefficient of a sound field spectrum.
Figure 24:
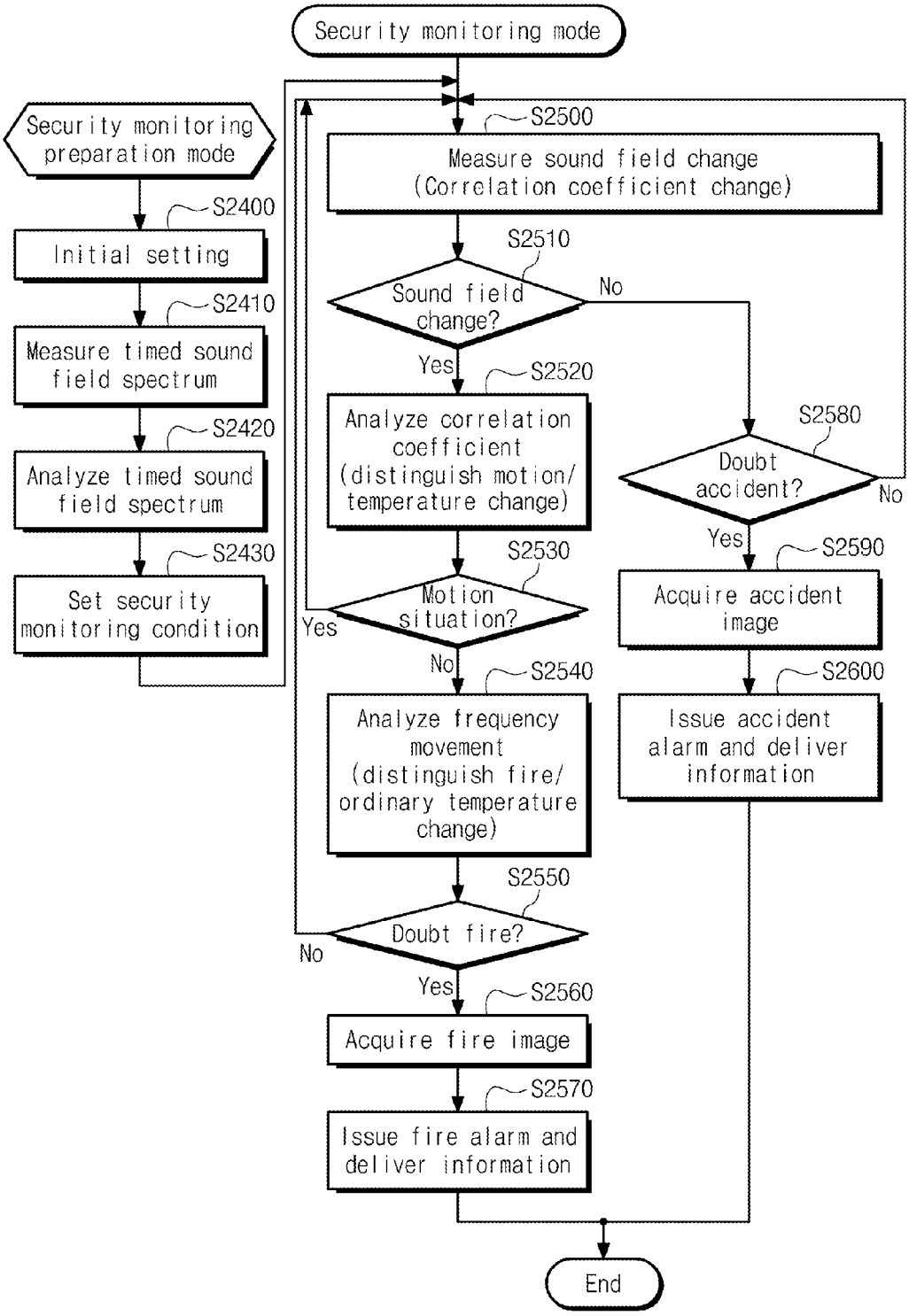
FIG. 24 is flow chart of a dangerous situation monitoring operation for detecting an accident occurrence of the elderly living alone or a pet distinguishably from fire and an ordinary temperature variation situation on the basis of a correlation coefficient of a sound field spectrum.

In this case, a function is necessary which neglects intrusion situation or an ordinary temperature variation and distinguishably detect a fire situation. When motion detection does not occur for a long time, and a procedure is operable which issues an accident occurrence alarm of falling, fainting, and invalidity, etc. FIGS. 23 and 24 are respectively a conceptual diagram and a flowchart representing this function.

FIG. 23 is a view representing that since a boundary condition is changed by a situation where the elderly living alone or pets move inside a security monitoring space, a sound transfer function changes and accordingly a sound field varies. Similarly, in the security monitoring space, an air temperature is changed by fire occurrence, air-conditioning and heating, or daily temperature range, and accordingly a sound wave speed changes and then a sound field variation occurs. In a case of no motion for a predetermined time, since there may be a danger of accident occurrence of falling, fainting, and invalidity etc., it is necessary to detect the danger and detection of a fire situation is also necessary. However, since motion or fire situation may be wrongly detected by a sound field variation occurring due to air-conditioning and heating or daily temperature range, a procedure and process for distinguishing this situation is also necessary.

FIG. 24 is flow chart of a dangerous situation monitoring operation for detecting an accident occurrence of the elderly living alone or a pet distinguishably from fire and an ordinary temperature variation situation on the basis of a correlation coefficient of a sound field spectrum. Referring to FIG. 24, a security monitoring method according to an embodiment of the present invention is largely divided into a preparation mode and a monitoring mode.

The preparation mode may include an operation S2400 of initial setting, an operation S2410 of measuring a sound field spectrum according to time, an operation S2420 of analyzing the sound field spectrum according to time, and an operation S2430 of setting a security monitoring condition.

The monitoring mode includes an operation S2500 of measuring a sound field spectrum variation for measuring a correlation coefficient variation, an operation S2510 of determining a sound field variation, an operation S2520 of distinguishing a motion/temperature variation through correlation coefficient analysis, an operation S2530 of determining a motion situation, an operation S2540 of distinguishing fire/ordinary temperature variation by analyzing a frequency movement index, an operation S2550 of determining a fire situation, an operation of S2560 of acquiring a fire image, an operation S2570 of issuing a fire alarm and delivering the alarm, an operation S2580 of doubting an accident by determining that a motion does not occur for a predetermined time in operation S2510 of determining a sound field variation, an operation S2590 of acquiring an accident image, and an operation S2600 of issuing an accident alarm and delivering information.

Operation S2400 of initial setting in the security monitoring preparation mode to operation S2500 of measuring a sound field variation in the security monitoring mode are the same as those of FIG. 22, but different in that only a hard of hearing or inaudible frequency of 15 kHz or higher is available as frequencies of the multi-tone sound source. In addition, in a case of FIG. 22, abrupt intrusion is monitored in a state of no motion, but in a case of FIG. 24, a state with a continuous motion is monitored.

In operation S2510 of determining a sound field variation, the sound field signal processing device 130 compares a current sound field spectrum according to frequency with a reference sound field spectrum according to frequency to determine whether a sound field variation occurs. In detail, the sound field signal processing device 130 determines that a sound field variation occurs when a correlation coefficient between the reference sound field spectrum and a current sound field spectrum is smaller than a set reference value.

In operation S2520 of analyzing a correlation coefficient of a sound field spectrum, when it is determined that the sound field variation occurs, the sound field signal processing device 130 analyzes a variation of a correlation coefficients with sound field spectra within a certain predetermined period right before occurrence of the security situation. However, in this case, since a condition that there is a continuous motion of a human and an animal is normal, it is difficult to use an index value representing a rapid variation degree of a correlation coefficient as in Equation (8), and it is distinguishable by using an index representing whether the correlation coefficient is continuously reduced or irregularly increased or decreased within a certain time period right before a sound field variation is detected. At this point, the reference sound field is re-initialized as a previously measured sound field spectrum for a predetermined period ahead right before the security situation occurs.

As shown in FIG. 22, a method is also available which sets a previous measurement sound field for a predetermined period ahead as the reference sound field, and also successively moves the reference sound field every time the current sound field is measured.

Figure 25:
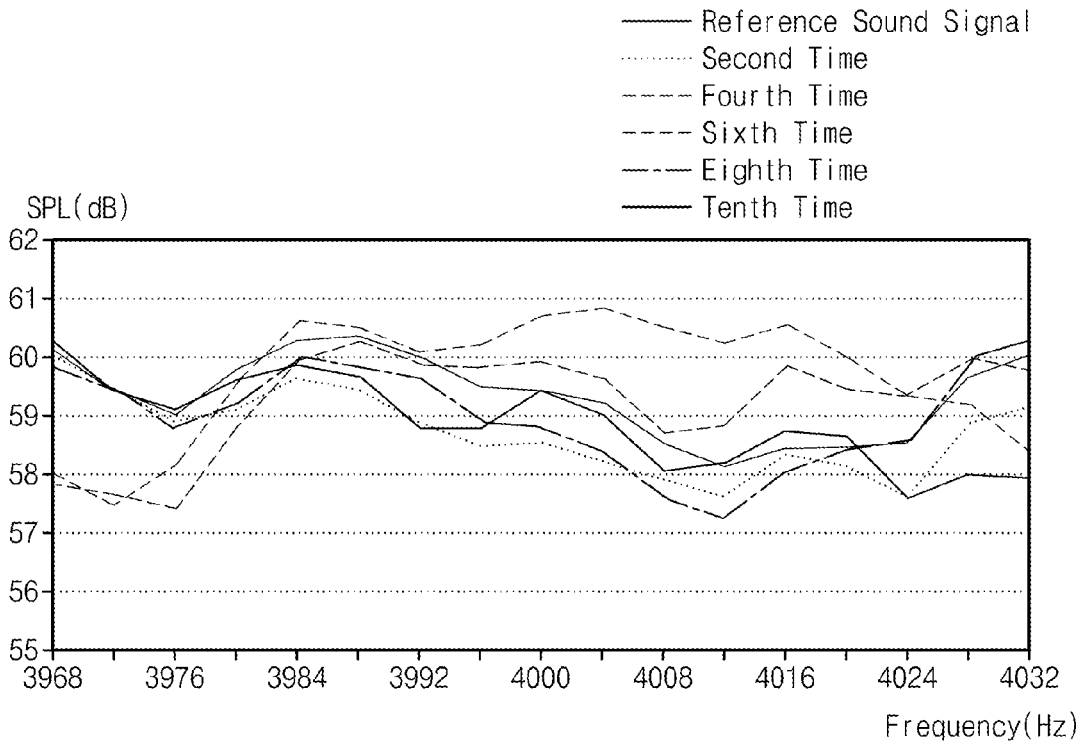
FIG. 25 is a view representing a sound field spectrum variation appeared in a situation where a person continuously moves in measurements of the reference sound field and consecutive sound fields by using a multi-tone sound source having a central frequency of 4 kHz and a frequency interval of 4 Hz.

FIG. 25 shows an experiment result that the reference sound field spectrum is measured in the security monitoring space and then a sound field spectrum is consecutively measured 10 times with a time interval of 8 seconds. FIG. 25 shows a sound field spectrum obtained in a situation where a dummy assumed as a human slowly moves from first to tenth measurements. The multi-tone sound source used for the sound field measurement has a central frequency of 4 kHz and frequencies of total 17 channels. It is a sound field spectrum result obtained by generating a sound source for 0.5 second by the sound generating device 110 and frequency-filtering, by the sound field signal processing device 130, a sound signal obtained by the sound receiving device 120. The sound field spectrum rapidly varies at every moment.

Figure 26:
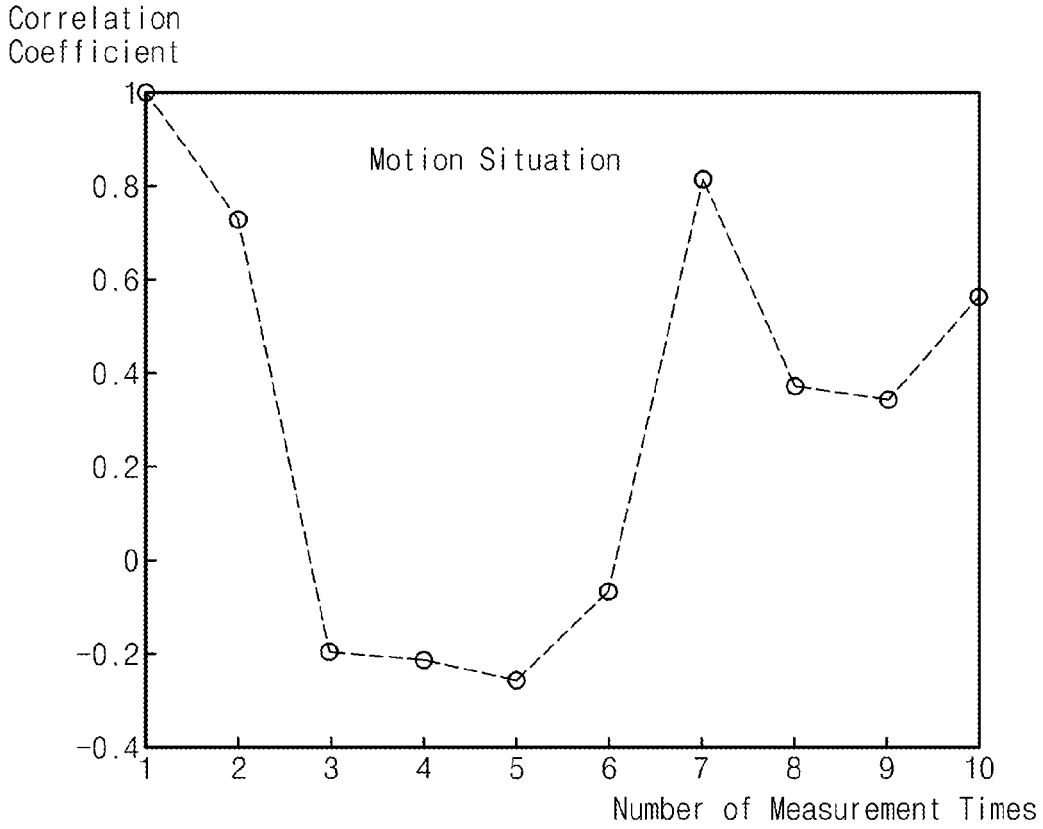
FIG. 26 is a view representing correlation coefficients without frequency movement (m=0) between a reference sound field measurement value and each of consecutive measurement values in the sound field spectra obtained from FIG. 25.

FIG. 26 is a view representing a correlation coefficient between the reference sound field spectrum and consecutive sound field spectra at every measurement in case where m=0. Referring to FIG. 26, it may be seen that for initial measurement, the correlation coefficient rapidly falls below 0 and an increase and decrease variation appears irregularly and greatly according to the number of measurement times. The correlation coefficient varying around 0 means that the sound spectra are completely different from each other. This may also include dynamic characteristics according to a human motion. In an actual security setting situation, a sound field variation is detected from initial measurement and all sound field spectra stored in a predetermined period are required to be considered and used for analysis.

Figure 27:
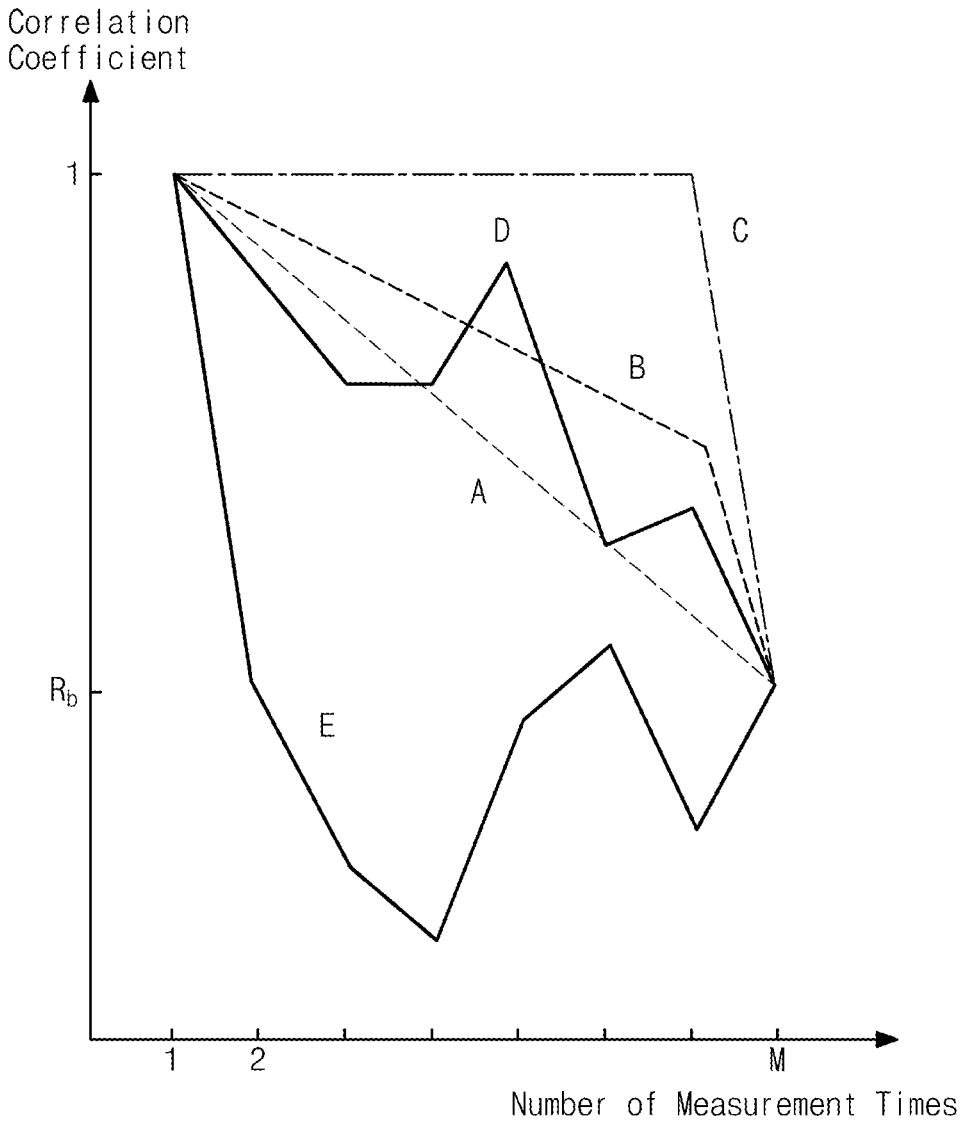
FIG. 27 is a view representing by comparing features of aspects that a correlation coefficient varies due to temperature change, intrusion and motion without frequency movement (m=0) between the reference sound field measurement value and each of consecutive measurement value.

FIG. 27 is a view representing a representative type of correlation coefficients (m=0 without frequency movement) between the reference sound field spectrum and sound field spectra in a certain predetermined period before occurrence of a sound field variation situation. Typically, the number of times M may be set as the number of times for re-initialization period, a graph A denoted with a dotted line represents a gradual temperature variation type, and a graph B shows a variation type of correlation coefficients due to a situation where a temperature variation and intrusion co-exist. In addition, a graph C shows a typical intrusion type, and graphs D and E are correlation coefficient types of a situation where a human continuously moves.

Equation (9) represents a movement index value obtained by summing absolute values of differences between adjacent correlation coefficients obtained through consecutive measurements over the entire period, and dividing the summed result by a value obtained by subtracting from 1 a correlation coefficient value $R_b$ at a time point of detection of a sound field variation. In the graphs A, B, and C of rapid temperature variation and intrusion situations, since a correlation coefficient is continuously reduced, the movement index value approaches almost 1. However, in the graphs D and E of continuously moving situations, since the correlation coefficients repeat increase and decrease, the movement index value becomes very large than 1.

Accordingly, when the movement index value MOVE obtained from Equation (9) is a predetermined value, for example, 2 or greater, it may be determined as a motion situation, and when MOVE is smaller than 2, it is determined as a temperature variation or intrusion situation.

$$\mathrm{MOVE} = \frac{\left(\mathrm{ABS}(1 - R_{0,1}(0)) + \sum_{i=1}^{M-1} \mathrm{ABS}(R_{0,i}(0) - R_{0,i+1}(0))\right.}{1 - R_b} \tag{9}$$

Since the intrusion is not considered, in case of using this method, motion and temperature variation situations may be distinguished. However, the method in the present invention is not limited hereto, and various methods may be applicable.

In practical, the movement index value MOVE obtained by using Equation (9) from the result of FIG. 26 is 6.8. This is very larger than 2. However, in a case of the temperature variation of FIG. 9, since the value of Equation (9) is almost 1, once the movement index value is obtained, the motion situation and the temperature variation situation are distinguishable.

When a motion situation is determined in operation S2530 of determining a motion situation, since it is a normal situation that the elderly living alone or a pet continuously moves indoors, the operation is returned to operation S2500 of measuring a sound field variation. Since there may be situation where a sound field is temporarily varied by external noise or electric noise of a device, as another embodiment of the present invention, a process may be added which re-measures a sound field by using an identical condition or greater sound pressure to check a sound field variation.

When a motion is not detected, since this is a sound field variation situation due to a temperature variation, fire and ordinary temperature variation situations are distinguished in operation S2540 of analyzing a frequency movement in FIG. 22. When a fire situation is evident in operation S2550 of doubting fire, the sound field signal processing device 130 acquires an image in operation S2560 of acquiring a fire image, issues a fire alarm and delivers information in operation S2570 of issuing a fire alarm and delivering information. In addition, an image captured through the camera module may be transmitted to a mobile phone, smart device, or a server of a guard house, a security company, or a police station through a wired or wireless communication network.

When a sound field is not detected in operation S2510 of determining a sound field variation, it is determined whether a motion has not been detected even once for a time interval set in operation S2580 of doubting an accident and also determined occurrence of an accident of falling, fainting, or invalidity. Accordingly the sound field signal processing device 130 acquires an accident image, issues an alarm, and delivers information thereof. An image captured through the camera module may be transmitted to a mobile phone, smart device, or a server of a guard house, a security company, or a police station through a wired or wireless communication network.

In an embodiment of the present invention, in the security monitoring concept and flowchart for distinguishably detecting intrusion, fire, and ordinary temperature variation as shown in FIGS. 1 and 22, under a condition that an intruder slowly moves inside the security space or intrudes in a state where there is a slight motion inside the security space, when an aspect of a temperature variation is not distinguished from this kind of intrusion situation and the intrusion situation is not detected due to non-rapid variation of a correlation coefficient of a sound field spectrum, a process may be added which distinguishes a temperature variation from a human motion as shown in FIG. 27 by using the movement detection index of Equation (9).

For example, after distinguishing an intrusion situation from a temperature variation situation by distinguishing intrusion from a temperature variation by using Equation (8), or dividing a period where a correlation coefficient is determined into a short period and a long period and typically differentiating a reference value of a correlation coefficient for determining the intrusion or temperature variation, reliability of security monitoring may be more improved by distinguishing a motion from a temperature variation by using the movement index of Equation (9) in the long period and delivering an intrusion detection alarm when there is a motion. In particular, for an intruder aiming at a weak point of the sound field security method and intruding while very slowly moving, the intrusion may be detected through the above-described method.

Figure 28:
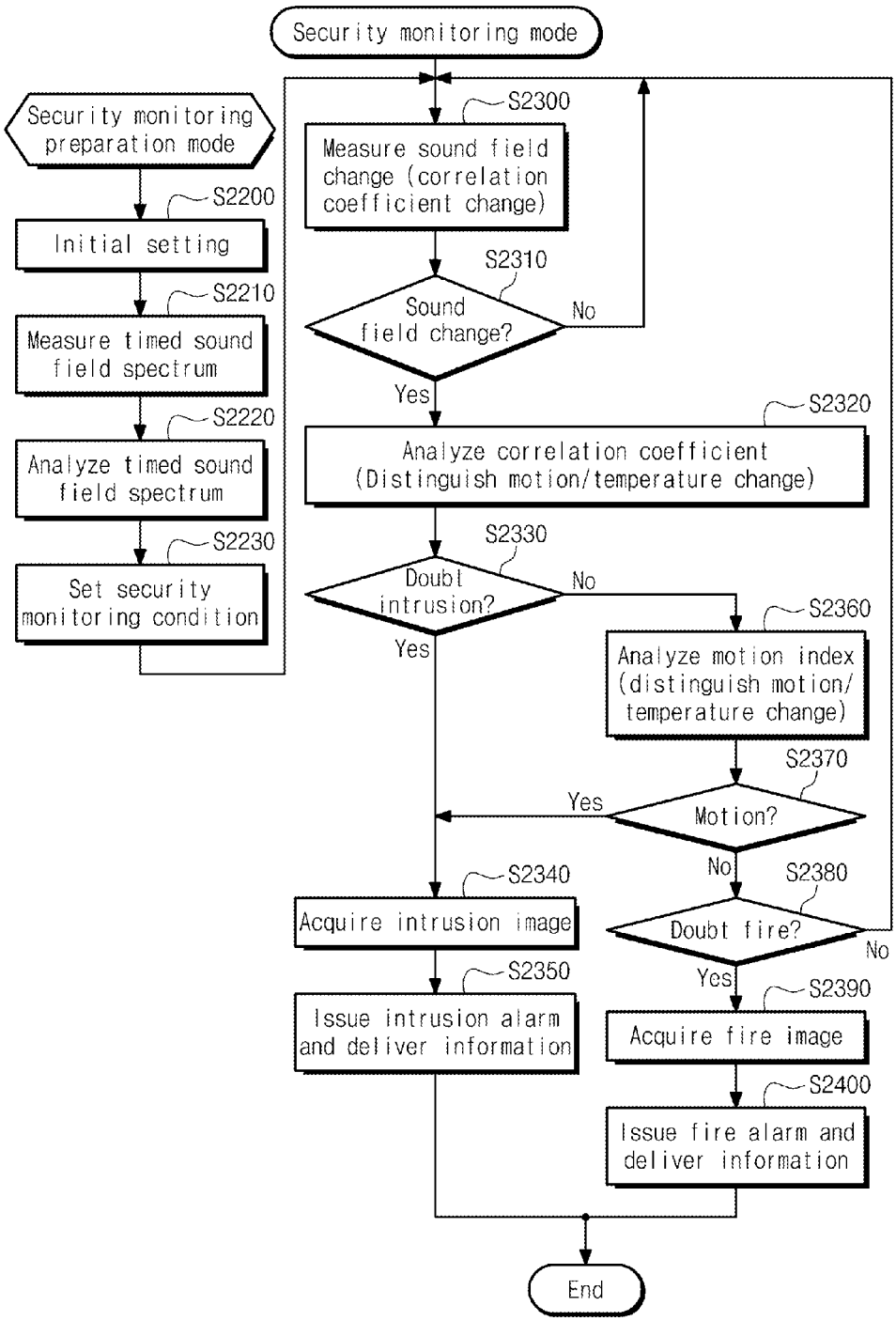
FIG. 28 is a flow chart is a flowchart of a security monitoring operation for distinguishing and detecting intrusion, motion, fire, and an ordinary temperature variation on the basis of a correlation coefficient of a sound field spectrum.

FIG. 28 illustrates a flowchart of a security monitoring operation for detecting a motion as well as intrusion, fire, and an ordinary temperature variation in an embodiment of the present invention. Almost same as operations of FIG. 22, but an operation S2360 of analyzing a movement index and an operation S2370 of distinguishing a motion from a temperature variation are further added. Accordingly, when determined as a motion, it is considered as intrusion and the operation of acquiring an intrusion image and issuing an alarm is executed. When determined as the temperature variation, and when determined as fire through operation S2390 of distinguishing fire from ordinary temperature variation, the operation of issuing an alarm is executed.

In addition, it is possible to implement a fire safety monitoring function for neglecting motions of humans in a space where the humans move and for selectively detecting only a fire situation. The range of the present invention includes all these various type of variations and modifications.

In an embodiment of the present embodiment, it is proposed that a security monitoring method of analyzing temporal variation aspect of a correlation coefficient of a sound field spectrum and distinguishing a dangerous situation, but it is also applicable to a security monitoring method of analyzing a variation aspect of a correlation coefficient for a central frequency before and at time point of occurrence of a dangerous situation and distinguishing the temperature variation from the intrusion/motion. For example, when a sound field spectrum is obtained by setting central frequencies as 1 kHz, 2 kHz, 4 kHz, and 6 kHz, respectively, and a frequency interval as 4 Hz, since frequency movement is large in case of a large central frequency for the temperature variation, a correlation coefficient between the reference sound field spectrum and the current sound field spectrum at the time of occurrence of dangerous situation becomes proportionally smaller as the central frequency is higher.

However, for object's intrusion or motion, since this proportional relationship does not consistently appear and shows irregular aspect, object's intrusion/motion and a temperature variation are distinguishable, even though only variations of correlation coefficients for plural central frequencies are observed by comparing the reference sound field spectrum with a current sound field spectrum measured once without consideration of a temporal variation aspect. Applying a movement index may be one embodiment where the movement index is obtained by representing the movement index of Equation (9) on a frequency axis, not on a number of measurement times (time) axis. It requires a relatively long time to measure correlation coefficients for the significantly large number of central frequencies, and measuring plural central frequencies causes partial sound pressure of multi-tone frequencies to be lowered and vulnerable to noise. However, security monitoring to which such a method is applied may be selected in a particular case.

In another embodiment of the present invention, as described above, when an analysis period unit of a sound field spectrum is set to a short period of twice or three times, a rapidly changing sound field spectrum may be selectively detected. Most of intrusion situations may be detected through this setting by simply comparing correlation coefficient variations and distinguishing from relatively slow temperature variation without using a rapid variation index of Equation (8) defined above. In a long period unit analysis executed together with this, a function of detecting a situation of falling, fainting, and invalidity of the elderly living alone inside a security space may be implemented through a method of distinguishably detecting the temperature and motion and monitoring that intrusion or motion does not occur for a predetermined time. At this point, in the short and long periods, a determination reference value of a correlation coefficient for determining intrusion/motion and temperature variation may be differently selected suitably for an environment.

As various use examples, a security monitoring apparatus to which such a security monitoring method is applied may be connected to an internet phone to be available in integral and external types. A security monitoring method according to an embodiment of the present invention may be applied to various kinds of smart devices, for example, a smart phone, or smart appliances including a smart TV, an interphone such as a door-phone or a video-phone.

Security monitoring methods using a variation pattern of a correlation coefficient of a sound field spectrum according to an embodiment of the present invention do not necessarily require a hardware change of an existing internet phone or smart device. In other words, when only embedding of a related algorithm is performed in an internal processor, linked use may be possible.

Security information according to an embodiment of the present invention may be delivered to various smart devices connected to a network as multimedia information such as texts or images. Moreover, when a user of a smart phone or a smart device accesses a related security system through an App type, various securities related services may be provided.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A security monitoring method of a security monitoring device, the method comprising:

outputting a multi-tone sound wave configured with a linear sum of sine waves having a plurality of frequency components inside a security monitoring space;

receiving the multi-tone sound wave calculating a sound field using the multi-tone sound wave;

calculating and storing sound field information according to frequency through the sound field;

determining whether a sound field variation occurs by comparing reference sound field information according to frequency with the currently measured sound field information; and distinguishing at least two events among intrusion, motion, and temperature variation situations on the basis of correlation between the reference sound field spectrum and consecutive sound field spectra by analyzing whether the sound field variation occurs collected for a certain predetermined period.

2. The method of claim 1, wherein the correlation is obtained by calculating a correlation coefficient value between the reference sound field spectrum and the consecutive sound field spectra.

3. The method of claim 1, wherein the correlation is obtained by using a correlation coefficient calculated by dividing a covariance value of the reference sound field spectrum and the consecutive sound field spectrum by multiplication of standard deviations of the reference sound field spectrum and the consecutive sound field spectrum.

4. The method of claim 1, further comprising:

comparing the reference sound field spectrum and a current sound field spectrum to determine whether a dangerous situation causing the sound field variation occurs;

distinguishing an intrusion, temperature variation, or motion situation by analyzing sound field spectra collected for a certain predetermined period before the dangerous situation occurs and; and distinguishing situations of the intrusion, motion, fire, and ordinary temperature variation comprising daily temperature range, and air conditioning and heating on the basis of the correlation coefficient between the reference sound field spectrum and the consecutive sound field spectra.

5. The method of claim 4, wherein whether the dangerous situation occurs is determined by comparing the correlation coefficient between the reference sound field spectrum and the current sound field spectrum with a set reference value.

6. The method of claim 1, wherein a variation pattern of the correlation coefficient between the reference sound field spectrum and the consecutive sound field spectra is used, a rapid reduction right before the occurrence of the dangerous situation is determined as the intrusion, and a gradual reduction right before the occurrence of the dangerous situation is determined as the temperature variation situation.

7. The method of claim 1, wherein the intrusion and temperature variation situations are distinguished by comparing a ratio of a value obtained by subtracting from 1 an average value of the correlation coefficient between the reference sound field spectrum and the consecutive sound field spectra before occurrence of a dangerous situation and a value obtained by subtracting from 1 a correlation coefficient between a sound field spectrum at a time point of occurrence of the dangerous situation and the reference sound field spectrum.

8. The method of claim 1, wherein a temporal variation aspect of a correlation coefficient between the reference sound field spectrum and the consecutive sound field spectra is analyzed, the irregularly increased and decreased variation aspect is determined as a motion; and the variation aspect of rapidly reduced is determined as an intrusion situation.

9. The method of claim 1, further comprising: determining whether a sound field variation occurs by comparing the reference sound field spectrum and a current sound field spectrum; and distinguishing a motion of a human/animal, fire, and an ordinary temperature variation situation comprising daily temperature range, and air conditioning and heating by analyzing sound field spectra according to frequency, which are collected for a predetermined period before occurrence of the sound field variation situation.

10. The method of claim 9, further comprising comparing the correlation coefficient between the reference sound field spectrum and current sound field spectrum with a set reference value to determine whether the sound field variation situation occurs.

11. The method of claim 1, wherein a temporal variation aspect of the correlation coefficient between the reference sound field spectrum and the consecutive sound field spectra is analyzed, when the variation aspect is irregular, the situation is determined as motion, and when the variation aspect is uniformly gradually reduced, the situation is determined as temperature variation situation.

12. The method of claim 1, wherein a correlation coefficient between the reference sound field spectrum and the consecutive sound field spectra in a predetermined period before occurrence of the sound field variation situation is used, a ratio of a value obtained by summing absolute values of differences between adjacent correlation coefficients obtained by consecutive measurement in a predetermined period and a value obtained by subtracting from 1 a correlation coefficient at a time point of detection of the sound field variation is set as a movement index, and the motion and the temperature variation are distinguished by using the movement index.

13. The method of claim 1, wherein an index representing a frequency movement degree of the sound field spectrum is derived on the basis of correlation coefficients between the reference sound field spectrum and the consecutive sound field spectra, which are obtained by adopting multi-tone frequency index as a variable, and a fire situation or an ordinary temperature variation situation comprising daily temperature range and air-conditioning and heating are distinguished by considering a direction and duration of the frequency movement.

14. The method of claim 9, further comprising detecting and storing motion information on a human and an animal inside a security space by using sound field information; and transmitting the detection information to a smart phone and a smart device of a protector.

15. The method of claim 9, further comprising delivering an alarm of occurrence of accident comprising falling, fainting, and invalidity, and transmitting security information at the time when the motions of a human and an animal in the security space are not detected for a pre-determined time.

16. The method of claim 1, wherein the security monitoring method is linked to a security camera having a network function, and smart appliances comprising an internet phone, a smart TV, and an interphone such a door-phone or a video-phone.

17. A security monitoring apparatus comprising:

a sound generating device configured to output a sound wave according to an input voltage in a security monitoring space;

a sound wave receiving device configured to receive the sound wave and calculate a sound field by using the sound wave; and a sound field signal processing device configured to calculate consecutive sound spectrum information on the sound field through consecutive measurement, to calculate cross correlation coefficients between the consecutive sound field spectrum information and reference sound field spectrum information, and to distinguish at least two events among intrusion, motion, and temperature variation situations through the cross correlation coefficient.

18. The apparatus of claim 17, wherein the sound wave is a multi-tone sound wave configured with a linear sum of sine waves having a plurality of frequency components.

19. The apparatus of claim 17, further comprising a memory configured to store the reference sound field spectrum information.

20. The apparatus of claim 17, wherein the sound field signal processing device calculates a sound transfer function by using sound pressure or a phase of the sound field.

* * * * *